United States Patent [19]

Suenaga

[11] 4,357,852

[45] Nov. 9, 1982

[54] GUITAR SYNTHESIZER

[75] Inventor: Noboru Suenaga, Fukuoka, Japan

[73] Assignee: Roland Corporation, Osaka, Japan

[21] Appl. No.: 150,074

[22] Filed: May 15, 1980

[30] Foreign Application Priority Data

| | | | |
|---|---|---|---|
| May 21, 1979 | [JP] | Japan | 54-68501[U] |
| Nov. 9, 1979 | [JP] | Japan | 54-156058[U] |
| Nov. 24, 1979 | [JP] | Japan | 54-162960[U] |
| Nov. 24, 1979 | [JP] | Japan | 54-162961[U] |
| Dec. 11, 1979 | [JP] | Japan | 54-171728[U] |
| Dec. 11, 1979 | [JP] | Japan | 54-171729[U] |
| Dec. 21, 1979 | [JP] | Japan | 54-178071[U] |
| Jan. 9, 1980 | [JP] | Japan | 55-1397[U] |

[51] Int. Cl.[3] ..... G10H 3/00

[52] U.S. Cl. ..... 84/1.16; 84/454; 84/DIG. 18; 84/1.03; 84/1.24

[58] Field of Search ..... 84/1.14, 1.16, 1.03, 84/454, 1.19, 1.24, 445, DIG. 18; 324/77 D, 78 F, 78 J; 179/1 SA, 1 SC

[56] References Cited

U.S. PATENT DOCUMENTS

| | | | |
|---|---|---|---|
| 3,916,751 | 11/1975 | Stich | 84/1.16 |
| 4,045,731 | 8/1977 | Tokunou et al. | 324/78 F |
| 4,150,253 | 4/1979 | Knoppel | 84/1.19 |
| 4,151,775 | 5/1979 | Merriman | 84/1.16 |
| 4,193,332 | 3/1980 | Richardson | 84/1.24 |
| 4,195,544 | 4/1980 | Koike | 84/1.24 |
| 4,203,338 | 5/1980 | Vidas | 84/445 |
| 4,300,431 | 11/1981 | De Rocco | 84/1.16 |

OTHER PUBLICATIONS

Lancaster, CMOS Cookbook, 1977, p. 200.

*Primary Examiner*—J. V. Truhe
*Assistant Examiner*—Forester W. Isen
*Attorney, Agent, or Firm*—W. G. Fasse; D. F. Gould

[57] ABSTRACT

A guitar synthesizer comprises a guitar portion and a synthesizer portion which are electrically connected to each other. The guitar portion includes strings stretched between a nut and a bridge and pickup means for detecting a string vibration for providing a guitar sound signal. The guitar sound signal is applied to the synthesizer portion. The synthesizer portion comprises a voltage controlled variable bandpass filter exhibiting a passband characteristic variable in at least two frequency regions of the guitar sound signal as a function of a control voltage. A frequency/voltage converter provides a control voltage representing the frequency of the output of the filter, to the variable bandpass filter, whereby the passband characteristic thereof is made adaptively and dominantly responsive to the frequency of the fundamental wave component included in the guitar sound signal and the fundamental wave component is extracted with accuracy from the guitar sound signal. The synthesizer portion comprises a fundamental wave signal processing unit responsive to the fundamental wave component for generating a fundamental wave associated signal having the same frequency as that of the fundamental wave component and an envelope signal generator responsive to the guitar sound signal for generating an envelope signal representing the envelope of the guitar sound signal. The fundamental wave associated signal is modulated with the envelope signal for synthesizing.

33 Claims, 21 Drawing Figures

PRIOR ART 40
41
410
411
412
413
414
415
416
417
41a
41b
A
B
C
D
E
F
420
WAVE SHAPE
430
MONOSTABLE MULTIVIBRATOR
440
MONOSTABLE MULTIVIBRATOR
450
MIRROR INTEGRATE
451
452
453
460
SAMPLE HOLD
461
462
34
NOISE CANCEL
341
342
343
344
35
V-F CONV
47
THRESHOLD DET
V CONT VAR BANDPASS FLT
FROM 15
TO RECTIFY 310
TO MOD 36
TO DET 330
TO MOD 37
TO DET 330

GUITAR SYNTHESIZER

BACKGROUND OF THE INVENTION

1. Field of the Invention

The present invention relates to a guitar synthesizer. More specifically, the present invention relates to a guitar synthesizer for generating a synthesized sound through synthesization based on a guitar sound signal obtained by a string vibration by touching the strings of a guitar.

2. Description of the Prior Art

With the recent development of the electronic technology, a music synthesizer for generating a sound through synthesization thereof in an electronic manner has been proposed and put into practical use. A well-known example of such music synthesizer is adapted to generate a sound through electronic synthesization based on performance of a keyboard musical instrument comprising a plurality of keys. However, since there are more persons who play a string musical instrument such as a guitar than the number of persons who have been versed in performing a keyboard musical instrument, it is desirable to provide means for generating a sound through synthesization based on a guitar sound signal obtained through performance of a string musical instrument such as a guitar.

Although such an apparatus has been proposed and put on market, such apparatus requires that a sound synthesized in an electronic manner is generated while an inherent feature of a guitar is maintained, in view of the fact that a sound is generated through electronic synthesization based on a guitar sound signal obtained by a string vibration. More specifically, such a synthesizer requires to extract only a fundamental wave component from a guitar sound signal which is obtained by a string vibration and includes harmonics as well as a fundamental wave component.

In extracting a fundamental wave component from a guitar sound signal including harmonics as well as a fundamental wave component obtained from a string vibration of a guitar, for example, conventionally several approaches have been employed, such as a peak holding approach for extracting a fundamental wave component by peak holding a guitar sound signal, a zero cross detecting approach for extracting a fundamental wave component responsive to a guitar sound signal crossing the zero level, and so on.

FIG. 1A shows waveforms for explaining the principle of the operation of the conventional approaches. Consider a case where a fundamental wave component is to be extracted in a rectangle waveform from a guitar sound signal as shown at (A) in FIG. 1A. According to the conventional peak holding approach, the positive and negative peak values of the guitar sound signal are stored and a pulse as shown at (B) in FIG. 1A is generated in synchronism with the peak of the guitar sound signal such that the polarity of the pulse is reversed for each period after one peak value is stored until the following peak value is stored. The approach is based on the thought that peaks appear in association with the fundamental wave component included in the guitar sound signal. On the other hand, according to the zero crossing detection approach, a pulse of a waveform as shown at (C) in FIG, 1A is generated such that the polarity of the pulse is reversed each time when guitar sound signal crosses the zero level. In other words, the approach is based on the thought that the zero crossing occurs in association with the fundamental wave component included in the guitar sound signal.

However, the above described conventional approaches involve a problem because an erroneous detection is liable to occur. More specifically, if and when a guitar sound signal obtained from a string vibration of the strings dominantly comprises a fundamental wave component, the waveform of such guitar sound signal is rather close to the waveform of the fundamental wave component and hence the above described basic thoughts are true and it is possible to extract the fundamental wave component with accuracy. However, if and when such guitar sound signal comprises many harmonic components as well as a fundamental wave component, an erroneous detection of the fundamental wave is liable to occur according to the above described conventional approaches.

FIG. 1B shows waveforms for explaining such malfunction in the extraction of a fundamental wave component according to the above described conventional approaches. Assuming a waveform of a guitar sound signal as shown at (A) in FIG. 1B, which comprises many harmonic components as well as a fundamental wave component, according to the above described peak hold approach, the fundamental wave component is not properly extracted as shown at (B) in FIG. 1B, inasmuch as peaks associated with the fundamental wave component and other peaks not associated with the fundamental wave component are both detected. Similarly, according to the zero crossing detection approach, the zero crossing associated with the fundamental wave component and other zero crossing occurring not in association with the harmonic components are both detected and hence the fundamental wave component is improperly detected as shown at (C) in FIG. 1B. When a guitar sound signal is generated from a string vibration of the strings of such as a guitar, such harmonic components are liable to occur toward the end of an attenuating guitar sound signal rather than at the beginning of a guitar sound signal shortly after the string is touched. Such harmonic components are also liable to occur when a guitar is played using a pick. Accordingly, it is desirable that a guitar synthesizer is provided which is capable of extracting a fundamental wave component with accuracy from a guitar sound signal including harmonics as well as a fundamental wave component throughout the full period of a guitar sound signal obtained from a string vibration caused by touching the strings.

SUMMARY OF THE INVENTION

The present invention comprises a guitar synthesizer comprising a guitar portion and a synthesizer portion electrically connected to each other, characterized in that a guitar sound signal is generated from a string vibration caused by touching the strings of the guitar, such guitar sound signal including harmonics as well as a fundamental wave component. The guitar sound signal is applied to a voltage controlled variable bandpass filter the passband characteristic of which is variable in at least two frequency regions of the frequencies of the fundamental wave component as a function of a control voltage. The frequency of the output of the voltage controlled variable bandpass filter is converted into a voltage associated with the frequency of the output of the voltage controlled variable bandpass filter. The frequency associated voltage is applied to the voltage controlled variable bandpass filter as a control voltage, so that the passband characteristics of the voltage controlled variable bandpass filter is adaptably and dominantly responsive to the frequency of the fundamental wave component included in the guitar sound signal, whereupon a fundamental wave associated signal having the same frequency as that of the fundamental wave component is generated. An envelope signal representing the envelope of the guitar sound signal is also generated based on the guitar sound signal and a synthesized guitar sound is generated through synthesization of the above described fundamental wave associated signal and the envelope signal. According to the present invention, even if a harmonic component is included toward the end portion of the guitar sound signal, a fundamental wave component can be extracted with accuracy from the guitar sound signal while the harmonic component is made less dominant or is removed from the guitar sound signal by extraction and the fundamental wave component is made dominant.

In a preferred embodiment of the present invention, a string vibration is detected individually for each of a plurality of strings of a guitar and the voltage controlled variable bandpass filter is adapted such that the passband characteristic thereof of each string is variable into two frequency regions of a higher frequency region and a lower frequency region depending on the positions of the frets of the guitar. As a result, a fundamental wave component can be extracted with accuracy even from vibrating sounds of the same pitch, i.e. the frequency, but of different tones obtained from different strings.

In a further preferred embodiment of the present invention, generation of the envelope signal is disabled responsive to an abrupt variation of the frequency of the fundamental wave component extracted from the guitar sound signal. As a result, in such a case where the sound is stopped by releasing the string from depression thereof by a finger or the sound is terminated by forcibly stopping the string vibration with a finger, it is possible to prevent the sound from being heard as if the same is unclearly cut or to prevent an actual cut of the sound from being delayed as compared with an operation for stopping the sound.

Accordingly, a principal object of the present invention is to provide an improved guitar synthesizer for generating a synthesized guitar sound through synthesization based on a guitar sound signal obtained from a string vibration of the strings of a guitar.

Another object of the present invention is to provide a guitar synthesizer adapted to extract with accuracy a fundamental wave associated signal from a guitar sound signal obtained from a string vibration and including a harmonic component as well as a fundamental wave component, while the harmonic component is removed from the guitar sound signal in extracting the fundamental wave component therefrom, thereby to make dominant the fundamental wave component.

Still another object of the present invention is to provide a guitar synthesizer, wherein a sound obtained by touching the strings of a guitar can be instantaneously stopped in a clean cut manner where it is desired to stop.

Still a further object of the present invention is to provide an improved guitar synthesizer which is capable of generating various sorts of effect sound that cannot be obtained in usual performance of a guitar.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1A:
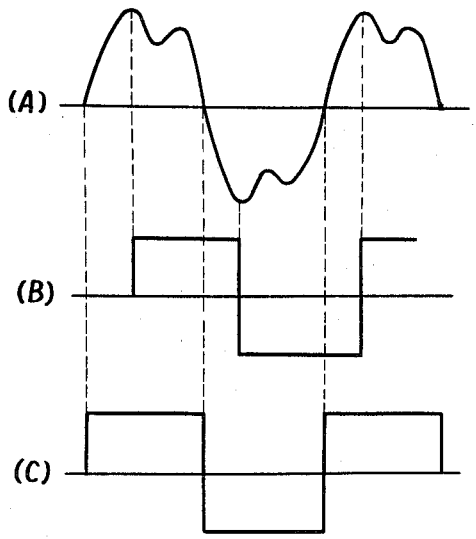
FIGS. 1A and 1B are waveforms for explaining the operation of the principle of extraction of a fundamental wave component from a guitar sound signal for use in a conventional guitar synthesizer.
Figure 1B:
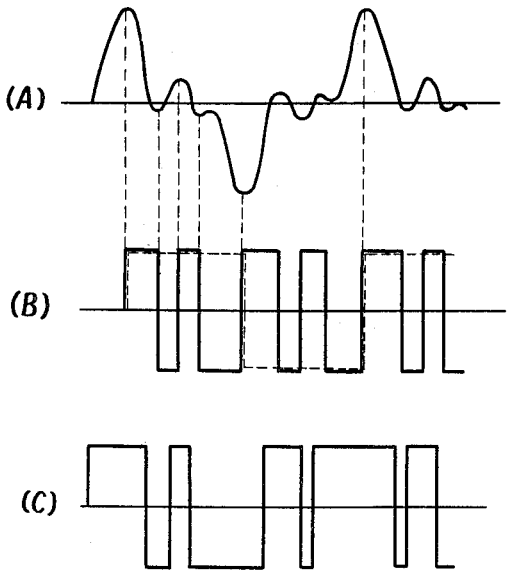
PRIOR ART FIG. 1B
Figure 2:
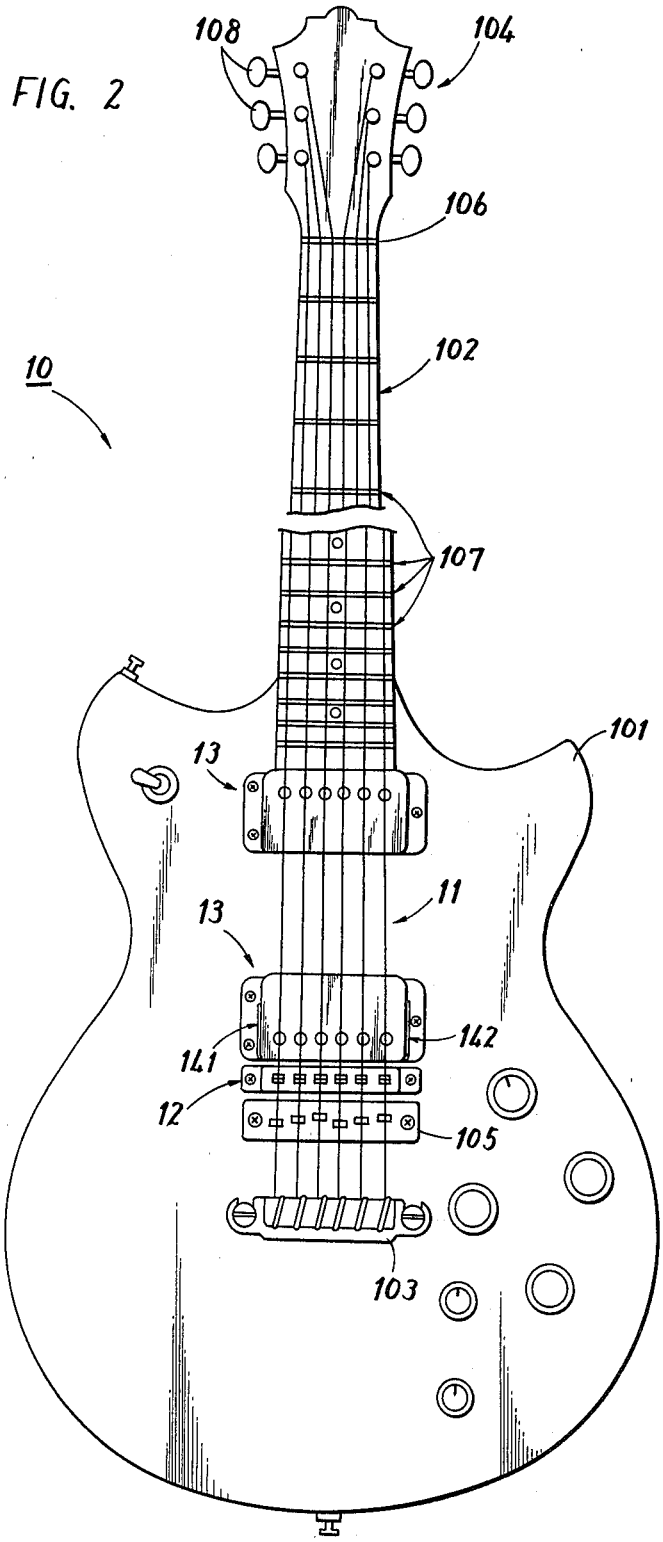
FIG. 2 is a plan view of a guitar portion of one embodiment of the present invention.
Figure 3:
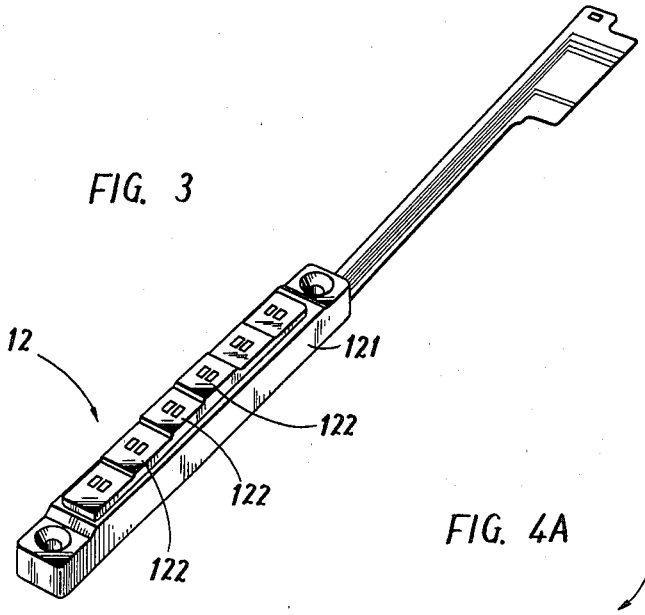
FIG. 3 is a perspective view of a pickup device provided in the guitar portion.
Figure 4A:
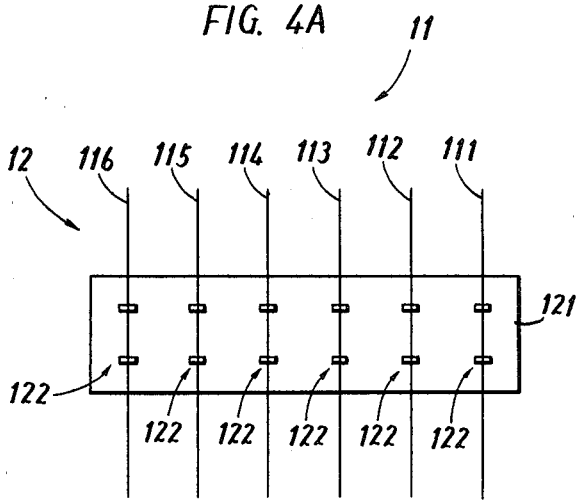
FIG. 4A is a plan view showing in detail the pickup device.
Figure 4B:
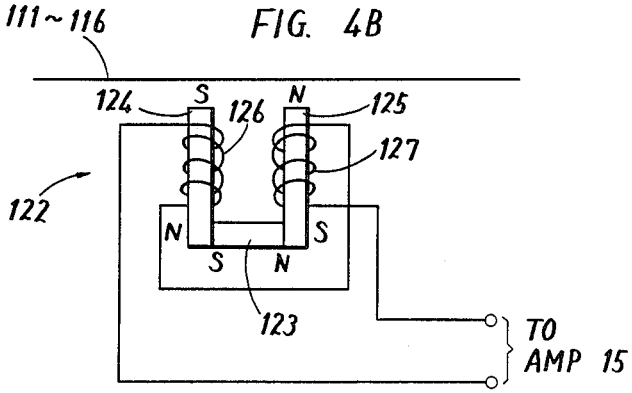
FIG. 4B is an enlarged side view of one pickup portion included in the pickup device.

FIG. 2 is a plan view of a guitar portion of one embodiment of the present invention. The guitar portion 10 comprises a main body 101, a neck 102 connected to one end of the main body 101 in the longitudinal direction, a tail piece 103 mounted on the surface of the main body 101, and a head 104 mounted at the end of the neck 102. A bridge 105 is provided on the surface of the main body 101 in the vicinity of the tail piece 103 and a nut 106 is provided intermediate the neck 102 and the head 104. A plurality of frets 107 are mounted on the surface of the neck 102 so as to protrude from the surface of the neck 102 extending in the direction orthogonal to the longitudinal direction of the neck 102 and at suitable intervals. Six strings 111 to 116, generally denoted as 11, are tightly stretched in parallel with predetermined spacings, with the same engaged at one end with the tail piece 103 and wound at the other end on the corresponding pegs 108 at the head 104, so that the respective strings 11 are tight-stretched between the bridge 105 and the nut 106, each with a suitable tension. A first pickup device 12 to be described in detail below with reference to FIGS. 3, 4A and 4B is provided below the strings 11 in the vicinity of the bridge 105 for detecting a vibrating sound of each of the strings, so that the detected output may be used for providing a fundamental wave associated signal in association with the vibrating sound. A second pickup device 13 is further provided below the strings 11 so as to be commonly sensitive to the vibrating sounds of the above described six strings. Generally, the sound pickup device 13 is positioned on the surface of the main body 101 closer to the bridge 105, if and when a hard sound is to be detected. The pick-up 13 is positioned on the surface of the main body 101 closer to the neck 102, when a soft sound is to be detected. Such a pickup device 13 may be provided at both positions as described above. Touch plates 141 and 142 of a touch switch 41 are provided at both sides of the second pickup device 13 at the positions slightly outside of the outermost ones of the strings 11. The touch switch 14 will be described in detail below with reference to FIG. 5. Several control knobs are suitably provided on the surface of the main body 101. A connector terminal, not shown, is provided at the side of the main body 101 for the purpose of withdrawing various electrical signals associated with the pickup devices 12 and 13 and the above described control knobs to a synthesizer portion 20, to be described subsequently with reference to FIG. 6.

Now referring to FIGS. 3, 4A and 4B, the second pickup device 12 will be described in detail. First referring to FIG. 3, the second pickup device 12 comprises six pickups 122 corresponding to the above described six strings 111 to 116 housed in a package 121 with the same spacing as that between the strings. Now referring to FIG. 4A, the pickup device 12 is positioned on the surface of the main body 101, such that the respective pickups 122 lie below the corresponding strings 111 to 116. FIG. 4B shows in detail a positional relation of one string and one pickup 122. The pickup 122 comprises magnetic cores 124 and 125 coupled to and magnetized by a permanent magnet 123, and coils 126 and 127 wound on the magnetic cores 124 and 125, respectively. The winding directions are opposite to each other. Referring to FIG. 4B, assuming that the string is stationary, no change occurs in the magnetic flux applied by the permanent magnet 123 to the magnetic cores 124 and 125 and hence no current is caused to flow in the coils 126 and 127. Now assuming that the string is touched and is vibrated, the string made of a magnetic material cuts the magnetic flux repetitively due to the vibration, thereby to cause an increasing or decreasing change of the magnetic flux at both cores 124 and 125. Accordingly, a current is caused to flow in the coils 126 and 127 so as to prevent such increasing or decreasing change in the respective directions determined by the directions of the respective magnetic fluxes at the cores 124 and 125. Since the directions of the magnetic fluxes of the magnetic cores 124 and 125 are opposite to each other and the coils 126 and 127 are wound in the opposite directions, the currents flowing in the coils connected in series flows in the same direction, i.e. in a summed up manner. Since the string is vibrated and the respective fluxes of the cores change in an increasing and decreasing manner in alternate directions, an alternating current is generated in the coils 126 and 127. Now assuming that an external electromagnetic disturbance is influences the pickup, such disturbance is effective on the magnetic cores 124 and 125 in the same direction and a disturbance electromagnetic force is generated in the coils 126 and 127 to give rise to the magnetic polarity in the same direction. However, since the coils 126 and 127 are wound in opposite directions and connected in series, the disturbance currents in the magnetic coils 126 and 127 cancel each other, so that no overall disturbance current is caused. Thus, a pickup device is provided that is individually sensitive to the strings but non-sensitive to external disturbances.

Figure 5:
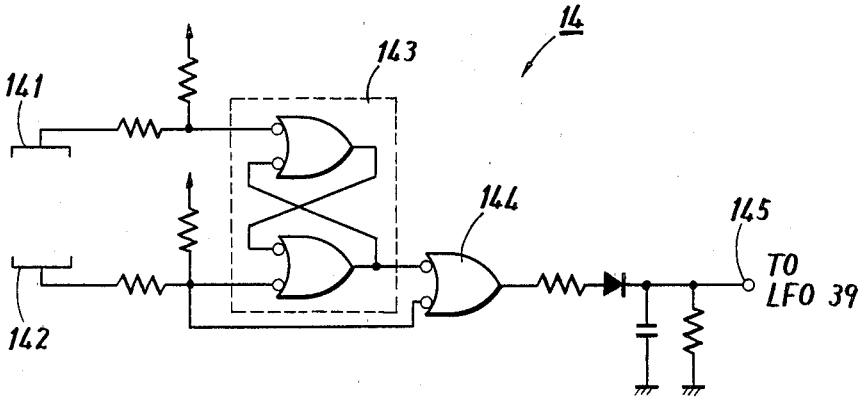
FIG. 5 is a schematic diagram of a touch switch.

Now referring to FIG. 5, a touch switch 14 associated with the second pickup device 13 will now be described in detail. The touch switch 14 comprises the touch plates 141 and 142 formed at both sides of the second pickup device 13, which are coupled to a set input and a reset input, respectively, of a flip-flop 143. The set output of the flip-flop 143 and the output of the touch plate 142 are connected to the inputs of an OR gate 144, the output of which is connected to an output terminal 145.

In operation, upon touching the touch plate 141 by a finger, the flip-flop 143 is reset responsive to the high level output from the touch plate 141 and as a result the high level signal is obtained from the output terminal 145. Even after the finger is removed from the touch plate 141 in such a situation, the flip-flop 143 remains set and the high level signal is maintained at the output terminal 145. If and when a finger touches the touch plate 142 and is removed therefrom in such a situation, the flip-flop 143 is reset and as a result the high level signal so far maintained at the terminal 145 now becomes the low level. Insofar as the touch plate 142 is touched by a finger, the high level output from the touch plate 142 is kept applied to the OR gate 144 and accordingly the high level signal is maintained at the output terminal 145. If and when the finger is removed therefrom the high level output from the touch plate 142 is terminated and the high level output from the output terminal 145 turns to the low level. Thus, the output terminal 145 is maintained in the high level during a time period when the touch plate 142 is touched by the finger.

The output of the touch switch 14 is used as a signal for selecting a vibrato effect in a guitar performance, for example, and to that end the output signal obtained from the output terminal 145 is applied through a low frequency oscillator 39 to be described below to an inverse logarithmic converting circuit 38. Since the touch switch 14 is structured using the touch plates 141 and 142 in the above described manner, the touch switch 14 can be provided at a position convenient to playing a guitar.

Now referring to FIG. 6, a synthesizer portion 20 for generating a guitar tone synthesized by playing the guitar portion 10 will now be described. The synthesizer portion 20 comprises a casing 201, an upper front portion 202 of which is formed in an oblique plane. A plurality of foot switches 211 to 215 are provided on the upper front portion 202. The foot switch 211 is used to enable a duet effect performance to be described below. The foot switches 212 and 213 are used to select the pitch on the occasion of a sweep effect performance to be described below. The foot switch 214 is used to control the tone forming circuit 50 to be described below with reference to FIG. 7 with an envelope signal. The foot switch 215 is used to control the tone forming circuit 50 through inversion of the envelope signal. Light-emitting diodes 221 to 225 are provided on the upper surface of the casing 202 corresponding to the respective foot switches 211 to 215. The display manners of the respective light-emitting diodes 221 to 225 are selected such that if and when any of the foot switches is not operated the corresponding one of the light-emitting diodes 221 to 225 is caused to make a blinking display, thereby to enable a player to discern the respective locations of the foot switches even in a dark place, and if and when any one of the foot switches is operated or depressed by a foot, the corresponding one of the light-emitting diodes 221 to 225 is controlled to make a continuous lighted display. A plurality of operation knobs 231 to 238 are further provided on the upper surface of the casing 201. Although not shown, a plurality of connector terminals are provided at the side of the casing 201. The connector terminals are used for connection to the guitar portion 10.

Figure 7:
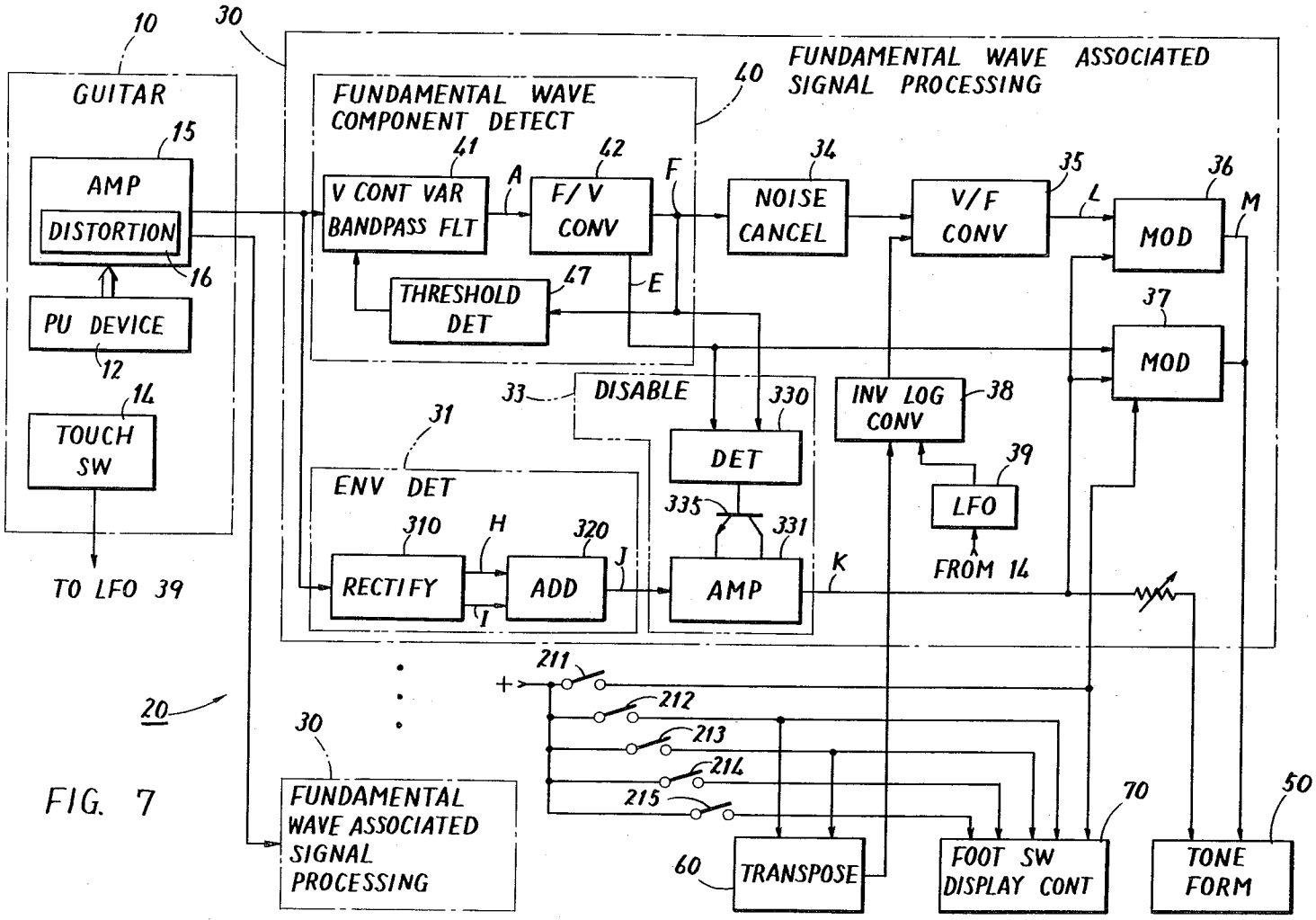
FIG. 7 is a block diagram of one embodiment of the present invention.

FIG. 7 is a block diagram of the guitar synthesizer which comprises the features of the present invention. The guitar portion 10 comprises a pickup device 12 described in detail with reference to FIGS. 3, 4A and 4B, the touch switch 14 and an amplifier 15. The amplifier 15 serves to amplify the guitar sound signals obtained in response to the string vibration of the respective strings detected by the pickups of the pickup device 12 and to provide the respective outputs to the synthesizer portion 20. The amplifier 15 may comprise a distortion circuit 16, to be described below with reference to FIG. 16, as necessary. The distortion circuit 16 is used to apply a desired distortion to the guitar sound signals as picked up, thereby to provide guitar sound signals of different tones.

The synthesizer portion 20 comprises six fundamental wave associated signal processing circuits 30, each for extracting a fundamental wave component from a guitar sound note signal for each string for synthesization of a guitar sound with an envelope signal generated on the basis of the guitar sound signal, whereupon the output is applied to the tone forming circuit 50. In FIG. 7, only one fundamental wave associated signal processing circuit 30 for one string is illustrated in detail, while the remaining fundamental wave associated signal processing circuits 30 are shown in a simplified manner, for simplicity of illustration; however, substantially the same circuit configuration is employed in each of the remaining fundamental wave associated signal processing circuits 30. The synthesizer portion 20 further comprises the tone forming circuit 50 for forming a performance sound with a desired tone. The synthesizer portion 20 further comprises a transpose circuit 60 and a foot switch display control 70 for controlling a display by the light-emitting diodes 221 to 225 for displaying the operated states of the foot switches 211 to 215.

Now one fundamental wave associated signal processing circuit 30 will be described. The fundamental wave associated signal processing circuit 30 comprises a fundamental wave component detecting circuit 40 for extracting a fundamental wave component from a guitar sound signal including harmonics as well as a fundamental wave component obtained from the amplifier 15 and for generating, as a sound source signal, a fundamental wave associated signal E in a sawtooth wave form having the same frequency as that of the fundamental wave component and a voltage signal F associated with the frequency or pitch of the fundamental wave component. The fundamental associated signal processing circuit 30 also comprises an envelope detecting circuit 31 for detecting the envelope of the guitar sound signal for providing an envelope signal K representing an envelope of the guitar sound signal. The outputs E and F of the fundamental wave component detecting circuit 40 are applied to an envelope disabling circuit 33 for detection of an abrupt variation of the frequency of the fundamental wave component. The envelope disabling circuit 33 is responsive to an abrupt variation of the frequency of the fundamental wave component to disable the envelope detecting circuit 31, thereby to disable the generation of the envelope signal K. The output voltage F associated with the frequency or pitch of the fundamental wave component obtained from the fundamental wave component detecting circuit 40 is also applied through a noise canceling circuit 34 to a voltage/frequency converting circuit 35 for conversion of the frequency associated voltage F into another fundamental wave associated signal or another sound source signal having the frequency associated with the frequency associated voltage F and thus associated with the frequency or pitch of the fundamental wave component extracted from the guitar sound signal. The sound source signal output of the voltage/frequency converting circuit 35 and the envelope signal of the envelope detecting circuit 31 are applied to a modulating circuit 36, so that the sound source signal is modulated with the envelope signal K. The fundamental wave associated signal E having the same frequency as the fundamental wave component obtained from the fundamental wave detecting circuit 40 and the envelope signal K obtained from the envelope detecting circuit 31 are applied to another modulating circuit 37, so that the fundamental wave associated signal E is modulated with the envelope signal K. As necessary, the fundamental wave associated signal processing circuit 30 may further comprise an inverse logarithmic converting circuit 38.

The above mentioned fundamental wave component detecting circuit 40 comprises a voltage controlled variable bandpass filter 41 which is connected to the amplifier 15 and is responsive to a control voltage to exhibit a variable passband characteristic variable in higher and lower frequency regions of the frequencies of the fundamental wave component, a frequency/voltage converting circuit 42 for converting the frequency of the output of the voltage control variable bandpass filter 41 into a voltage signal F associated with the frequency of the output of the voltage controlled variable bandpass filter 41 and also providing a fundamental wave associated signal E in a sawtooth wave form having the same frequency as that of the fundamental wave component, and a threshold detecting circuit 47 connected to the frequency/voltage converting circuit 42 for threshold detecting the frequency associated voltage F at a predetermined level for providing a control voltage to the voltage controlled variable bandpass filter 41. More specifically, the voltage controlled variable bandpass filter 41 is responsive to a control voltage to exhibit a passband characteristic which is variable in two frequency regions within the frequency range of the fundamental wave component as a function of the control voltage. The respective frequency regions are selected such that the passband characteristic is adaptively and dominantly responsive to the frequency of the fundamental wave component included in the guitar sound signal obtained from the amplifier 15. Such control voltage is obtained by level detecting the frequency associated voltage F obtained from the frequency/voltage converting circuit 42. Accordingly, the detection level by the threshold detecting circuit 47 is selected for the above described purpose. As a result, if and when the frequency of the fundamental wave component is in a higher frequency region, the frequency associated voltage F from the frequency/voltage converting circuit 42 is level detected such that the level detected output may control the filter 41 to attain the passband characteristic in the higher frequency region. When the frequency of the fundamental wave component is in a lower frequency region, the frequency associated voltage from the frequency/voltage converting circuit 42 is level detected such that the level detected output may control the filter 41 to attain the passband characteristic in the lower frequency region. Thus, the passband characteristic of the voltage controlled variable bandpass filter 41 is adapted to the frequency region of the fundamental wave component extracted from the guitar sound signal as a function of the voltage F associated with the frequency of the output of the filter 41 whereby the fundamental wave component is accurately extracted from the guitar sound signal. In the embodiment shown, the frequency/voltage converting circuit 42 is structured to provide the above described frequency associated voltage F in response to each preceding cycle of the fundamental wave component and to provide the above described fundamental wave associated signal E in a sawtooth wave form in response to each succeeding cycle of the fundamental wave component, to be more fully described below.

The envelope disabling circuit 33 is responsive to the above described frequency associated voltage F and the above described sawtooth wave signal E to evaluate a difference therebetween and thus a difference between the voltage levels at the preceding and succeeding cycles of the fundamental wave component, for the purpose of detecting an abrupt variation of the frequency of the fundamental wave component. To that end, the envelope disabling circuit 33 comprises a difference detection circuit 330 and a disabling control transistor 335 for disabling the output of the envelope detecting circuit 31 upon detection of a predetermined difference between the voltage levels at the preceding and succeeding cycles of the fundamental wave component.

The envelope detecting circuit 31 comprises a rectifying circuit for rectifying the guitar sound signals both in one phase and in the opposite phase and an adding circuit 320 for adding the one phase rectified output and the opposite phase rectified output. As a result, an envelope signal K representing an envelope of the guitar sound signal is obtained from the envelope detecting circuit 31. The envelope signal K is applied to the modulating circuits 36 and 37 for the purpose of amplitude modulation.

In a normal state when the envelope disabling circuit 33 does not provides a disabling signal, the frequency associated voltage F obtained from the frequency/voltage converting circuit 42 undergoes noise removal by the noise canceling circuit 34, whereupon the output thereof is applied to the voltage/frequency converting circuit 35. The voltage/frequency converting circuit 35 generates a sawtooth wave having a frequency corresponding to that of the above described frequency associated voltage and thus to the frequency of the fundamental wave component. The output of the voltage/frequency converting circuit 35 is applied to the modulating circuit 36 as the above described other fundamental wave associated signal or the other sound source signal L. The modulating circuit 36 serves to modulate the sound source signal L of the sawtooth wave form with the envelope signal K obtained from the envelope detecting circuit 31, thereby to provide a modulated output to the tone forming circuit 50. The tone forming circuit 50 will be described in detail below with reference to FIG. 11.

In generating a performance sound in a duet manner through synthesization of the fundamental wave associated signal L obtained in response to each preceding cycle of the fundamental wave component included in the guitar sound signal and the fundamental wave associated signal E obtained in response to each succeeding cycle of the fundamental wave component included in the guitar sound signal, the modulating circuit 37 is enabled in response to depression of the duet performance enabling foot switch 211 so that the fundamental wave associated signal E in the sawtooth wave form obtained from the frequency/voltage converting circuit 42 and applied to the modulating circuit 37, is modulated with the envelope signal K obtained from the envelope disabling circuit 33. The modulated output from the modulating circuit 36 and the modulated output from the modulating circuit 37 are synthesized and applied to the tone forming circuit 50, whereby a duet effect sound is generated.

In the case of a sweep effect performance wherein the pitch of a tone produced by playing the guitar is to be shifted, the transpose circuit 60 is responsive to depression of the foot switches 212 and 213 to provide a voltage signal for changing the pitch of the synthesized sound. The pitch changing voltage signal is applied to the inverse logarithmic converting circuit 38. The inverse logarithmic converting circuit 38 serves to change the output voltage of the transpose circuit 60 in an inverse logarithmic functional manner, thereby to provide the output to the voltage/frequency converting circuit 35 as a frequency controlling voltage. As a result, the frequency of the output of the voltage/frequency converting circuit 35 is changed smoothly in a sweep effect performance. To that end, the voltage/frequency converting circuit 35 comprises a voltage controlled variable frequency oscillator the output frequency of which is variable as a function of both the voltage obtained from the noise canceling circuit 34 and the voltage obtained from the inverse logarithmic converting circuit 38.

Now the purpose of the inverse logarithmic converting circuit 38 will now be described. Inherently the frequency or the pitch of the output signal of the voltage controlled oscillator includes a change as high as two times the frequency for one octave. In other words, it is necessary to double the control signal voltage (a pitch voltage) in order to raise the pitch by one octave. However, such doubling is extremely inconvenient. Therefore, the control signal voltage of the voltage controlled oscillator is applied to the voltage controlled oscillator through the inverse logarithmic converting circuit 38. In other words, according to the embodiment shown, a control signal voltage having a constant voltage variation for each octave is applied as an input voltage to the inverse logarithmic converting circuit 38 and the output voltage which has been amplified two times per one octave, is obtained from the inverse logarithmic converting circuit 38. Therefore, when such output voltage is applied to the voltage controlled oscillator as a control signal, the frequency of the output signal of the voltage/frequency converting circuit 35 exhibits a change of two times per one octave with respect to a linear change of the input voltage of the inverse logarithmic converting circuit 38. As a result, the voltage control is conveniently achieved.

Now referring to FIG. 8, the fundamental wave component detecting circuit 40, and the noise canceling circuit 34 will be described in detail. The voltage controlled variable bandpass filter 41 comprises a cascade connection of feedback type filters 41*a* and 41*b*. The filters 41*a* and 41*b* each comprise a negative feedback amplifier comprising an amplifier 411 and a negative feedback circuit including a series connection of a resistor 412 and a capacitor 413 and coupled between the negative feedback input and output of the amplifier 411. A series connection of a resistor 414 and a field effect transistor 415 and a series connection of resistors 416 and 417 are connected in parallel between the junction of the resistor 412 and the capacitor 413 and ground. The field effect transistor 415 serves to change the resistance value between the junction of the resistor 412 and the capacitor 413 and ground when the field effect transistor 415 is rendered non-conductive or conductive. As a result, the voltage controlled variable bandpass filter 41 serves as a low pass filter if and when the field effect transistor 415 of each of the filters 41*a* and 41*b* is rendered non-conductive and serves as a high pass filter if and when the field effect transistor 415 of each of the filters 41*a* and 41*b* is rendered conductive. More specifically, if and when the output of the threshold detecting circuit 47 is at the low level, the field effect transistor 415 of each of the filters 41*a* and 41*b* is rendered non-conductive. As a result, the time constant determined by the capacitor 413 and the series connection of the resistors 416 and 417 and the series connection of the resistor 414 and the field effect transistor 415 is increased. On the other hand, the junction of the resistors 416 and 417 associated with the increased time constant has been connected to the positive feedback input of the amplifier 411. Accordingly, the passband of the voltage controlled variable bandpass filter 41 is changed to a lower frequency region. On the other hand, if and when the output of the threshold detecting circuit 47 is at the high level, the field effect transistor 415 of each of the filters 41*a* and 41*b* is rendered conductive and accordingly the time constant determined by the capacitor 413 and the series connection of the resistors 416 and 417 and the series connection of the resistor 414 and the field effect transistor 415 is decreased. The voltage at the junction of the resistors 416 and 417 associated with the decreased time constant is applied to the positive feedback input of the amplifier 411. As a result, the filters 41*a* and 41*b* are controlled to function as high pass filters and accordingly the passband of the voltage controlled variable bandpass filter 41 is changed to a higher frequency region. Thus, the passband of the voltage controlled variable bandpass filter 41 is controlled to either a higher frequency region or a lower frequency region as a function of the output of the threshold detecting circuit 47. The above described higher frequency region and the lower frequency region are selected to cover the frequencies of the fundamental wave component included in the guitar sound signal. The frequency/output voltage characteristic of the voltage controlled bandpass filter 41 when the bandpass characteristic thereof is switched to a lower frequency band is shown by the curve $f_L$ in FIG. 9 and the frequency/output voltage characteristic of the voltage controlled variable bandpass filter 41 when the bandpass characteristic thereof is switched to a higher frequency region is shown by the curve $f_H$ in FIG. 9. The central frequency of the passband when the filter 41 functions as a low pass filter, is selected to correspond to the pitch when the string is released. On the other hand, the central frequency of the passband when the filter 41 functions as a high pass filter, is selected to correspond to the pitch when the same string is depressed to cover twelve frets, i.e. the second harmonic of the pitch when the same string is released. The central frequency of the higher passband may be strictly the frequency of the second harmonic but alternatively may be a frequency in the vicinity of the second harmonic and for example may be selected to be the frequency corresponding to the pitch when the string is depressed to cover ten frets. Although in the foregoing embodiment the passband of the voltage controlled variable bandpass filter 41 was controlled to two frequency bands $f_L$ and $f_H$ for simplicity of structure, it is pointed out that the passband of the filter 41 may be divided into three or more frequency regions to cover a guitar sound signal.

Figure 8:
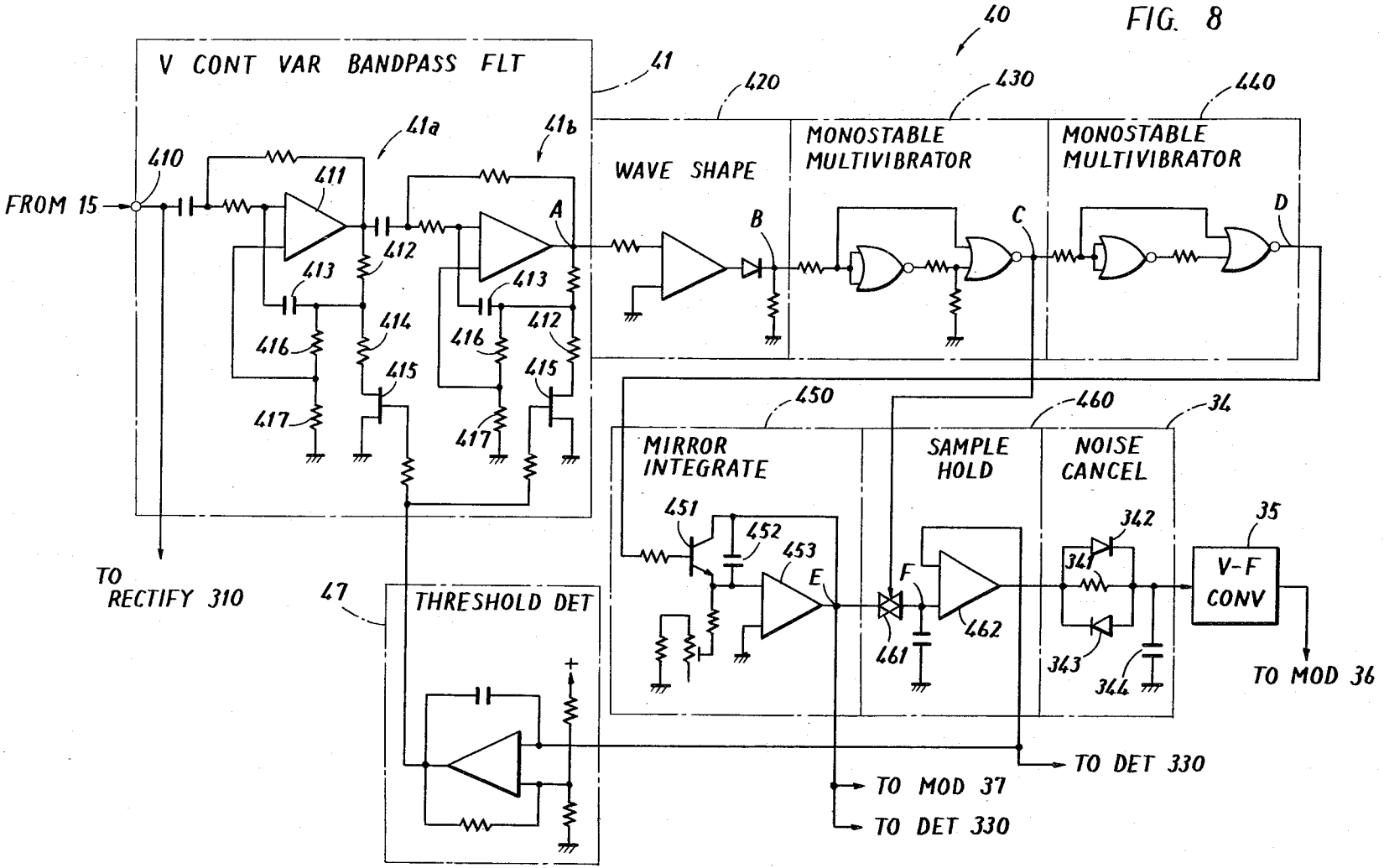
FIG. 8 is a schematic diagram showing in detail a fundamental wave component detecting circuit constituting a feature of the present invention and a noise canceling circuit.
Figure 8A:
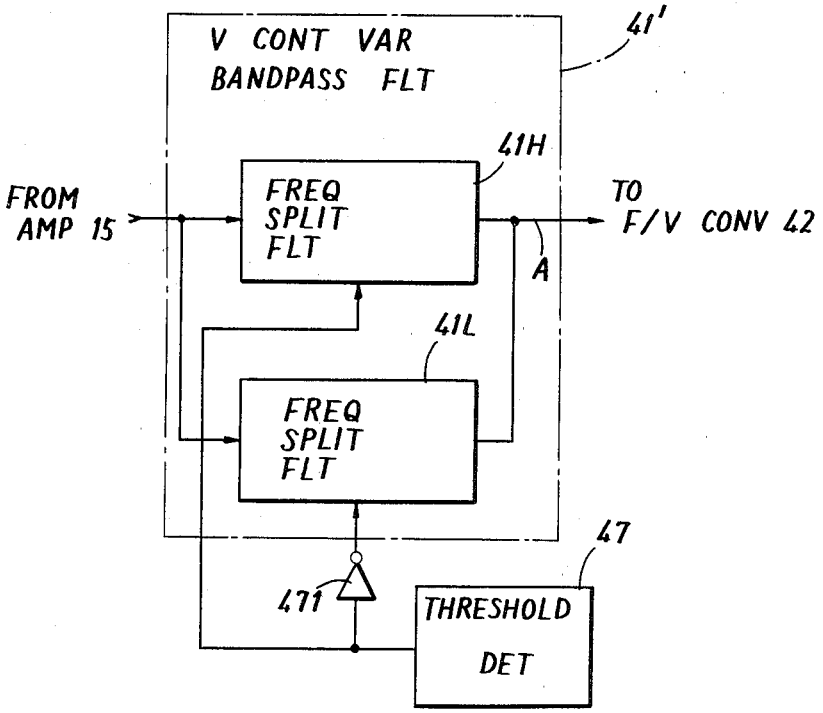
FIG. 8A shows a block diagram of another embodiment of a voltage controlled variable bandpass filter.

FIG. 8A shows a block diagram of another embodiment of a voltage controlled variable bandpass filter 41'. Referring to FIG. 8A, the voltage controlled variable bandpass filter 41' comprises two frequency splitting filters 41H and 41L selected to exhibit a higher passband characteristic $f_H$ and a lower passband characteristic $f_L$, respectively, shown in FIG. 9. The filters 41H and 42L are fundamental wave components. The output of the threshold detecting circuit 47 is directly connected to the frequency splitting filter 41H as an enable signal and the output of the threshold detecting circuit 47 is applied through an inverter 471 to the frequency splitting filter 41L as an enabling signal. In operation, if and when the output of the threshold detecting circuit 47 is at the high level, the frequency splitting filter 41H of the higher passband characteristic $f_H$ is enabled, whereas if and when the output of the threshold detecting circuit 47 is at the low level, the frequency splitting filter 41L of the lower passband characteristic $f_L$ is enabled. As a result, a voltage controlled variable bandpass filter 41' is provided which exhibits a passband characteristic which is changeable into two frequency regions as a function of a control voltage.

Figure 9:
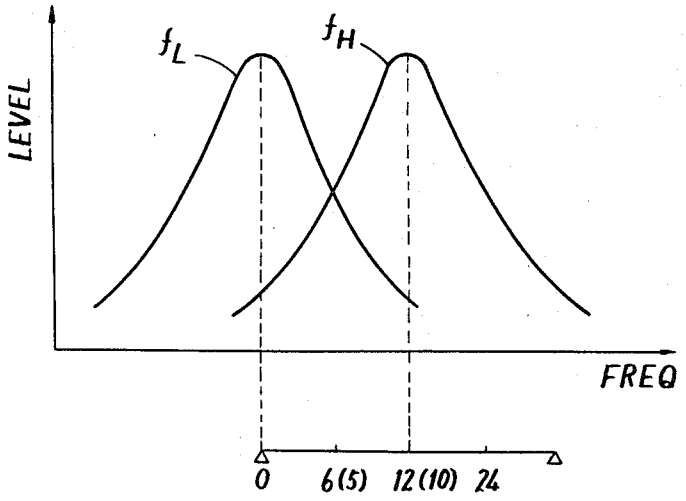
FIG. 9 is a graph showing a passband characteristic of a voltage controlled variable bandpass filter included in the fundamental wave component detecting circuit for explaining the principle thereof, and particularly showing a relation between the output voltage and the frequency with respect to the position of the fret of a guitar.

It has been observed that for the purpose of the present invention the high pass band characteristic $f_H$ shown in FIG. 9 attained by the voltage controlled variable bandpass filter 41 shown in FIG. 8 and by the voltage controlled variable bandpass filter 41' shown in FIG. 8A, may also cover the lower frequency region as well as the higher frequency region. Therefore, the voltage controlled variable bandpass filter for use in the present invention may be a voltage controlled variable low pass filter the cutoff frequency of which is variable as a function of a control voltage. It is intended that the present invention clearly covers such a voltage controlled variable low pass filter by the term "a voltage controlled variable bandpass filter".

The frequency/voltage converting circuit 42 comprises a wave shaping circuit 420, monostable multivibrators 430 and 440, a mirror integrating circuit 450, and a sample holding circuit 460.

Figure 10:
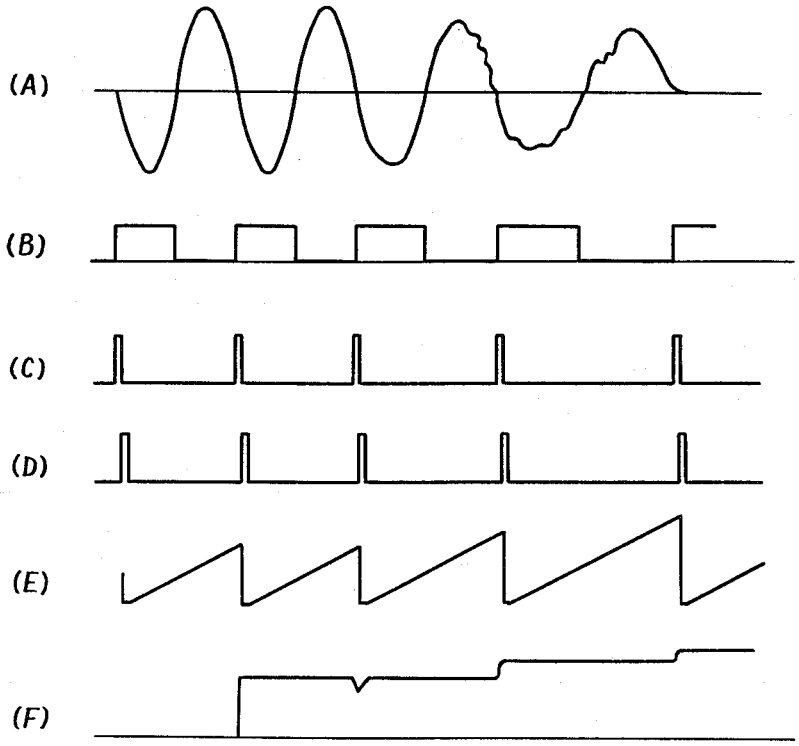
FIG. 10 shows waveforms of the signals at various portions of the fundamental wave component detecting circuit for explaining the operation thereof.

Now referring to FIGS. 8 to 10, the operation of the fundamental wave component detecting circuit 40 will be described. If and when a guitar sound signal is applied to the input terminal 410 of the voltage controlled variable bandpass filter 41, the guitar sound signal as shown at (A) in FIG. 10 of the frequency band determined on the basis whether the field effect transistor 415 is conductive or non-conductive, is obtained at the high level. The waveform of the guitar sound signal (A) is shaped by the wave shaping circuit 420, whereby a pulse as shown as (B) in FIG. 10 is obtained which is applied to the monostable multivibrator 430. The monostable multivibrator 430 is responsive to the rise of the pulse (B) to provide a pulse (C) having a small time width at the end of the preceding cycle of the guitar sound signal, which pulse is applied to the monostable multivibrator 440. The monostable multivibrator 440 is responsive to the fall of the pulse (C) to provide a pulse (D) having a small time width at the beginning of a succeeding cycle of the guitar sound signal. The pulse (D) is applied to a transistor 451 of the mirror integrating circuit 450 as a reset signal, whereby the transistor 451 is rendered conductive for only a short time period, thereby to instantaneously discharge a capacitor 452. The mirror integrating circuit 450 is responsive to the pulse (D) at the beginning of a succeeding cycle of the guitar sound signal to initiate an integrating operation by means of the capacitor 452 and the amplifier 453. Now assuming that a preceding cycle is progressing, then at the end of the preceding cycle of the guitar sound signal (A), the monostable multivibrator 430 provides the pulse (C), which enables an analog switch 461 included in the sample holding circuit 460, whereby the voltage (E) obtained at the end of the preceding cycle of the guitar sound signal (A) from the mirror integrating circuit 450 is sample held. Shortly after the pulse (C), the monostable multivibrator 440 provides the reset pulse (D) at the beginning of the succeeding cycle, whereby the mirror integrating circuit 450 is reset as a function of the pulse (D). As a result, the mirror integrating circuit 450 provides a sawtooth wave, the cycle and thus the amplitude of which is associated with the cycle or the frequency and thus the pitch of the succeeding cycle of the guitar sound signal shown as (A) in FIG. 10. On the other hand, the sample holding circuit 460 serves to sample hold a voltage shown as (F) in FIG. 10 associated with the frequency or the pitch of the preceding cycle of the guitar sound signal. Thereafter, the above described operation is repeated.

The voltage value held in the sample holding circuit 460 is applied to the threshold detecting circuit 47. The threshold detecting circuit 47 detects the threshold of the voltage value associated with the frequency or the pitch of the guitar sound signal of the preceding cycle at a predetermined reference voltage thereby to determine whether it is necessary to switch the passband of the voltage controlled variable bandpass filter 41. If it is not necessary to switch the passband, the output so far established is held, whereas if it is necessary to switch the passband, the output of the threshold detecting circuit 47 is reversed and the conduction state of the field effect transistors 415 of the filters 41*a* and 41*b* is reversed. Thus, the passband characteristic of the voltage controlled variable bandpass filters 41 is switched based on the voltage associated with the frequency of the preceding cycle of the guitar sound signal.

From the foregoing description, it would be appreciated that the frequency/voltage converting circuit 42 was structured to be responsive to the period of each cycle of the guitar sound signal to provide the voltage representing the period of each cycle of the guitar sound signal. In this context, strictly the frequency/-voltage converting circuit 42 should be called a period/voltage converting circuit. Nevertheless, it is recalled that the period or cycle is an inverse number of the frequency and thus the frequency/voltage converting circuit 42 may be considered as a frequency/voltage converting circuit structured to be responsive to the frequency of each cycle of the guitar sound signal to provide a voltage representing the frequency of each cycle of the signal. Of course, for the purpose of the present invention the frequency/voltage converting circuit 42 may be a frequency/voltage converting circuit responsive to the frequency of several cycles of the signal to provide a frequency representing voltage. Therefore, it is intended that for the purpose of the present invention the term "a frequency/voltage converting circuit" broadly covers a period/voltage converter as well as a frequency/voltage converter.

The voltage held as sample in the sample holding circuit 460, i.e. the voltage associated with the frequency or the pitch of the guitar sound signal is also applied to the noise canceling circuit 34 and a voltage variation detecting circuit 330 included in the disabling circuit 33. The noise canceling circuit 34 comprises a resistor 341 shunted by two diodes 342 and 343 in the opposite directions and the output terminal end thereof is connected to the ground through a capacitor 344. The noise canceling circuit 34 is aimed to remove an offensive noise component when the pitch associated voltage obtained from the frequency/voltage converting circuit 42 causes a jitter due to a variation of the cycle of the pulse (D). Considering a case where an offensive noise component is included in the pitch associated voltage obtained from the frequency/voltage converting circuit 42, the capacitor 344 is repetitively charged through the diode 342 and discharged through the diode 343 in accordance with a variation of the voltage level of the pitch associated voltage appearing at the input terminal of the noise canceling circuit 34. Even if the pitch associated voltage involves a minor voltage level variation based on a minor variation of the cycle of the guitar sound signal, the above described minor voltage does not become large enough to render the diodes 342 and 343 operable. Therefore, a charging/discharging operation is performed as a function of the variation of the voltage level with the time constant determined by the resistance value of the resistor 341 and the capacitance of the capacitor 344 of the noise canceling circuit 34. Accordingly, the output voltage appearing at the output terminal of the capacitor 344 becomes a waveform of the pitch associated voltage as obtained by smoothing the minor voltage, whereby the guitar sound note signal can be reproduced as a waveform free of a noise component.

Figure 11:
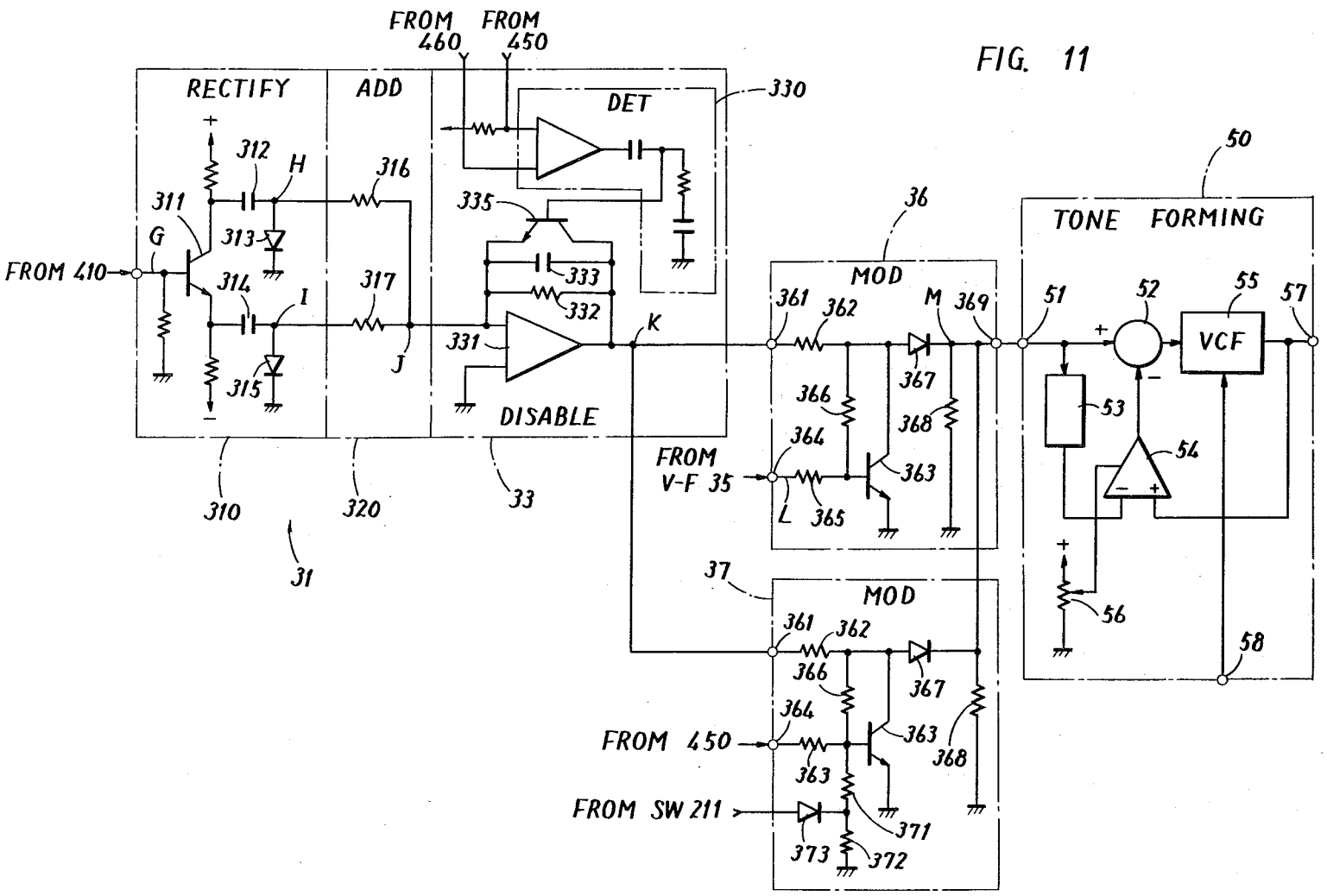
FIG. 11 is a schematic diagram of an envelope detecting circuit, an envelope signal disabling circuit, modulating circuits and a tone forming circuit.

Now referring to FIG. 11, the envelope detecting circuit 31, the disabling circuit 33, the modulating circuits 36 and 37 and the tone forming circuit 50 will be described in detail. The envelope detecting circuit 31 comprises the rectifying circuit 310 and the addition circuit 320. The rectifying circuit 310 comprises a transistor 311, the base electrode of which is connected to the input terminal 410 of the voltage controlled variable bandpass filter 41. A series connection of a capacitor 312 and a diode 313 is connected between the collector electrode of the transistor 311 and ground. A series connection of the capacitor 314 and a diode 315 is connected between the emitter electrode of the transistor 311 and ground. The junction H of the capacitor 312 and the diode 313 is connected to one end of a resistor 316. The junction I of the capacitor 314 and the diode 315 is connected to one end of a resistor 317. The collector electrode of the transistor 311 is connected to a positive voltage source through a resistor and the emitter electrode of the transistor 311 is connected to a negative voltage source through a resistor. The resistors 316 and 317 constitute the above described adding circuit 320. More specifically, the other ends of the resistors 316 and 317 are connected to a common junction J, thereby to constitute an adding circuit. The output terminal or junction J of the adding circuit 320 is connected to one input terminal of an amplifier 331 included in the disabling circuit 33. The other input terminal of the amplifier 331 is connected to ground. The amplifier 331 is shunted by a resistor 332 and a capacitor 333. The above described transistor 335 included in the disabling circuit 33 is connected in parallel with the capacitor 333.

Figure 12:
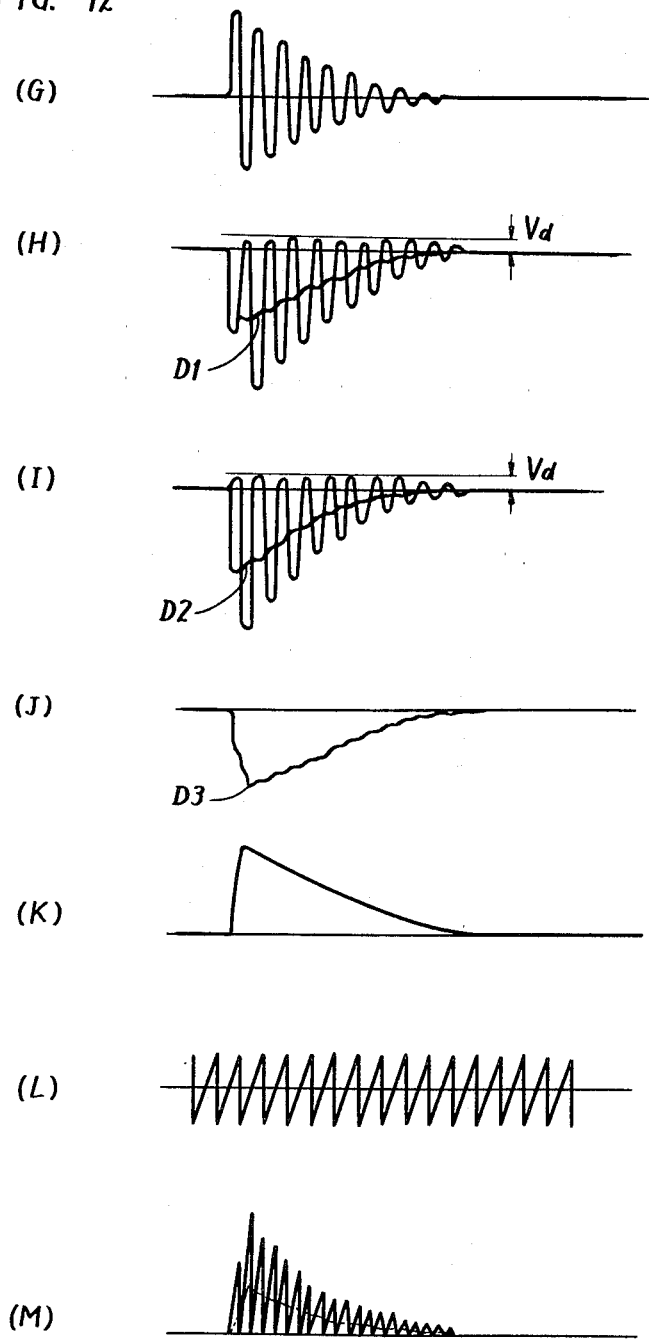
FIG. 12 is a graph showing waveforms for explaining the operation of the envelope detecting circuit and the modulating circuits.

Now referring to FIGS. 11 and 12, the operation of the envelope detecting circuit 31 will be described. If and when a guitar sound signal obtained by a string vibration as shown at (G) in FIG. 12 is applied to the base electrode of the transistor 311, a signal of the phase opposite to the above described guitar sound signal is obtained from the collector electrode of the transistor 311. On the other hand, a signal of the phase which is the same as that of the guitar sound note signal is obtained from the emitter electrode of the transistor 311. The capacitor 312 is charged with the positive component of the signal obtained from the collector electrode of the transistor 311 through rectification of the signal by means of the diode 313 and is discharged with the discharging time constant determined by the capacitor 312 and the resistor connected between the collector electrode of the transistor 311 and the positive voltage source. The terminal voltage of the capacitor 312 assumes a voltage waveform of the direct cutting component D1 shown at (H) in FIG. 12. The waveforms shown in FIG. 12 appear at the points in FIG. 11 which are designated with the same letters. Accordingly, the signal obtained at the anode of the diode 313 is of a waveform the phase of which is opposite to that of the guitar sound signal and which is shifted in its level by the direct current component D1 obtained by the charging/discharging operation of the capacitor 321 as shown at (H) in FIG. 12. Likewise, the capacitor 314 is charged with the positive component of the signal obtained from the emitter electrode of the transistor 311. The terminal voltage of the capacitor 314 has a waveform corresponding to the direct current voltage component D2 shown at (I) in FIG. 12. A voltage having a waveform the phase of which is the same as that of the guitar sound signal and which is shifted in its level by the direct current voltage component D2 as shown at (I) in FIG. 12, is obtained from the anode of the diode 315. In the figure, Vd denotes a forward voltage of the diode 313 and 315.

When the respective signals obtained at the junctions of the capacitor 312 and the diode 313 and of the capacitor 314 and the diode 315 are added by means of the resistors 316 and 317, the same cancel each other due to the opposite phases of the respective alternating current components, with the result that only the direct current component D3 shown as (J) in FIG. 12 is obtained as an envelope signal representing the envelope of the guitar sound note signal. More specifically, the envelope signal D3 has the same amplitude variation as that of the guitar sound signal with little ripple. For the purpose of further decreasing the ripple component, the envelope signal output of the addition circuit 320 is applied to the amplifier 331 of the disabling circuit 33. The amplified output of the amplifier 331 is fed back in a negative feedback manner through the parallel connection of the capacitor 333 and the resistor 332. As a result, the ripple component included in the envelope signal output is further smoothed and the envelope signal with extremely little ripple as shown as (K) in FIG. 12 is obtained from the output of the amplifier 331. Due to this structure of the envelope detecting circuit 31 an envelope signal having a small ripple component and a small response delay, is provided.

The disabling circuit 33 achieves a clean cut of the sound in the following manner when the sound is to be terminated. More specifically, the voltage variation detecting circuit 330 included in the disabling circuit 33 compares the voltage (F) associated with the pitch of a preceding cycle of the guitar sound signal held as sample in the sample holding circuit 460 and the voltage (E) associated with the pitch of the next succeeding cycle obtained from the mirror integrating circuit 450, thereby to detect that the sound was terminated by forcibly stopping the string vibration with a finger when the difference of the above described two voltages exceeds a predetermined value, i.e. when the decreasing change of the frequency of the guitar sound note signal is larger than a predetermined value, whereby the high level output is provided by the voltage variation detecting circuit 330. The transistor 335 is responsive to the high level signal from the voltage variation detecting circuit 330 to be rendered conductive, whereby the amplifier 331 of the disabling circuit 33 is short circuited, with the result that generation of the envelope signal is disabled.

Referring again to FIG. 11, the structure of the modulating circuit 36 will be described. A resistor 362 is connected between the input terminal 361 receiving the envelope signal and the collector electrode of a transistor 363 of the modulating circuit 36. A resistor 365 is connected between the base electrode of the transistor 363 and the input terminal 364 receiving the sound source signal obtained from the voltage/frequency converting circuit 35. A feedback resistor 366 is connected between the collector electrode and the base electrode of the transistor 363. A diode 367 is connected between the collector electrode of the transistor 363 and the output terminal 369 of the modulating circuit 36. A resistor 368 is connected between the cathode of the diode 367 and the ground.

In operation, with simultaneous reference to FIG. 12, the envelope signal K is applied to the input terminal 361. The sound source signal L of a sawtooth waveform obtained from the voltage/frequency converting circuit 35 is applied to the input terminal 364 of the modulating circuit 36. Accordingly, the modulating circuit 36 is responsive to the envelope signal to vary the current amplification factor of the transistor 363, thereby to modulate the sound source signal L with the envelope signal K at the input 361 to provide a modulated signal M. This modulation is assured by the feedback resistor 366 because the feedback makes sure that a collector current associated with the voltage of the sound source signal L applied to the input terminal 364, flows through the transistor 363. This current feedback operation provides a modulated signal M of a tone associated with the sound source signal L. Without the feedback resistor 366 the signal at the output terminal 369 would not have the just mentioned relationship with the sound source signal L. The modulated signal M is then rectified by the diode 367 to provide a reproduced guitar sound signal as shown at (M) in FIG. 12. The reproduced guitar sound signal (M) comprises a direct current voltage component of the waveform commensurate with the envelope signal K and the even and odd number harmonics of the sound source signal L. Thus, the modulating circuit 36 provides the reproduced guitar sound signal (M) of a sawtooth wave including both the harmonics of the even number and the odd number, without any decrease in the even number harmonics. As a result, a reproduced guitar sound signal maintaining the tone feature of the input sound source signal can be provided.

The modulating circuit 37 is constructed in substantially the same manner as that of the modulating circuit 36 and is used for a duet performance. To that end, the modulating circuit 37 comprises a modification set forth in the following, in addition to the structure of the modulating circuit 36. More specifically, a series connection of resistors 371 and 372 is connected between the base electrode of the transistor 363 and the ground and the cathode of a diode 373 is connected to the junction of the resistors 371 and 372. The anode of the diode 373 is connected to the output terminal of a foot switch 211 providing a switch depression signal or to the output terminal of the flip-flop for storing the state of depression of the foot switch 211. When the foot switch 211 is depressed, the high level output is applied through the diode 373 whereby the transistor 363 of the circuit 37 is suitably biased and the circuit 37 is enabled. The modulating circuit 37 receives at the input terminal 364 the sound source signal obtained from the mirror integrating circuit 450 and provides a reproduced guitar sound signal including the harmonics delayed by one cycle as compared with the cycle of the sound source signal obtained from the modulating circuit 36. More specifically, it is recalled that the sound source signal (L) being applied to the modulating circuit 36 was generated as a function of the voltage associated with the frequency or pitch of the preceding cycle of the guitar sound signal whereas the sawtooth wave signal (E) was generated as a function of the frequency or pitch of the succeeding cycle of the guitar sound signal, as previously described with reference to FIG. 8. Accordingly, the reproduced guitar sound signal obtained from the modulating circuit 37 is phase shifted as compared with the cycle of the reproduced guitar sound signal obtained from the modulating circuit 36. Hence by adding the outputs of the modulating circuits 36 and 37, a guitar sound signal of a duet performance is provided. The outputs of the modulating circuits 36 and 37 are applied to the input terminal 51 of the tone forming circuit 50.

Now the structure of the tone forming circuit 50 will be described in detail. The input terminal 51 is connected to the plus input of an adding circuit 52 and is also connected through a transfer function circuit 53 having a given transfer function to the minus input of a voltage controlled variable gain amplifier 54. The output of the voltage controlled variable gain amplifier 54 is connected to the minus input of the adding circuit 52. The output of the adding circuit 52 is connected to the signal input of a voltage controlled variable cutoff frequency filter 55. The output of the voltage controlled variable cutoff frequency filter 55 is connected to the plus input of the voltage controlled variable gain amplifier 54. As a result, a negative feedback circuit is constituted such that the output of the voltage controlled variable frequency filter 55 is fed back negatively through the voltage controlled variable gain amplifier 54 to the adding circuit 52. The voltage controlled variable gain amplifier 54 is structured such that the gain thereof is controlled by means of a variable resistor which is coupled between the positive voltage source and ground and accordingly serves as a potentiometer. Accordingly, the negative feedback circuit serves as a resonance circuit wherein the peak value occurring in the vicinity of the cutoff frequency is controlled through manual operation of the variable resistor 56. The voltage controlled variable cutoff frequency filter 55 receives at a control voltage input terminal 58 a control signal obtained by addition of the envelope signal and another signal for controlling the cutoff frequency of the voltage controlled variable cutoff frequency filter 55.

Figure 13:
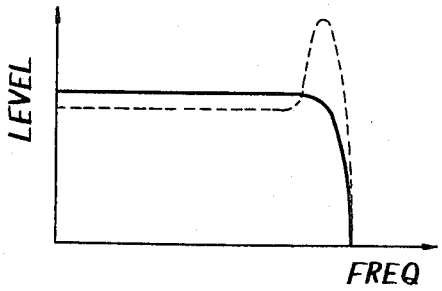
FIG. 13 is a graph showing waveforms for explaining the operation of the tone forming circuit.

In operation, the sound source signal, as modulated, is applied to the input terminal 51 of the tone forming circuit 50 and the control voltage is applied to the input terminal 58 of the tone forming circuit 50. A portion of the sound source signal is applied through the transfer function circuit 53 such as a resistor network or a variable resistor network having a given transfer function to the minus input terminal of the voltage controlled variable gain amplifier 54. The adding circuit 52 adds the sound source signal, as modulated, and the output of the voltage controlled variable gain amplifier 54 to provide the sum output to the voltage controlled variable cutoff frequency filter 55. The frequency characteristic of the voltage controlled variable cutoff frequency filter 55 when the variable resistor 56 is adjusted to its minimum value is shown by the solid curve in FIG. 13. The frequency characteristic of the filter 55 when the resistance value of the variable resistor 56 is adjusted to its maximum value for exhibiting a resonance is shown by the dotted line in FIG. 13. Accordingly, by manually operating the variable resistor 56 of the tone forming circuit 50 to control the resonance, correction can be made such that the level of a signal of a specified frequency may be increased, while a variation of the level of the other frequencies may be relatively small. More specifically, a special tone effect for increasing the level in the specified frequency can be attained. Stated differently, the feature of the tone forming circuit 50 resides in that the volume of the whole output musical note signal is not changed and the dynamic range is not narrowed even if the peak of the output level occurs in the vicinity of any arbitrary cutoff frequency; whereby the resonance control is effective.

Figure 14:
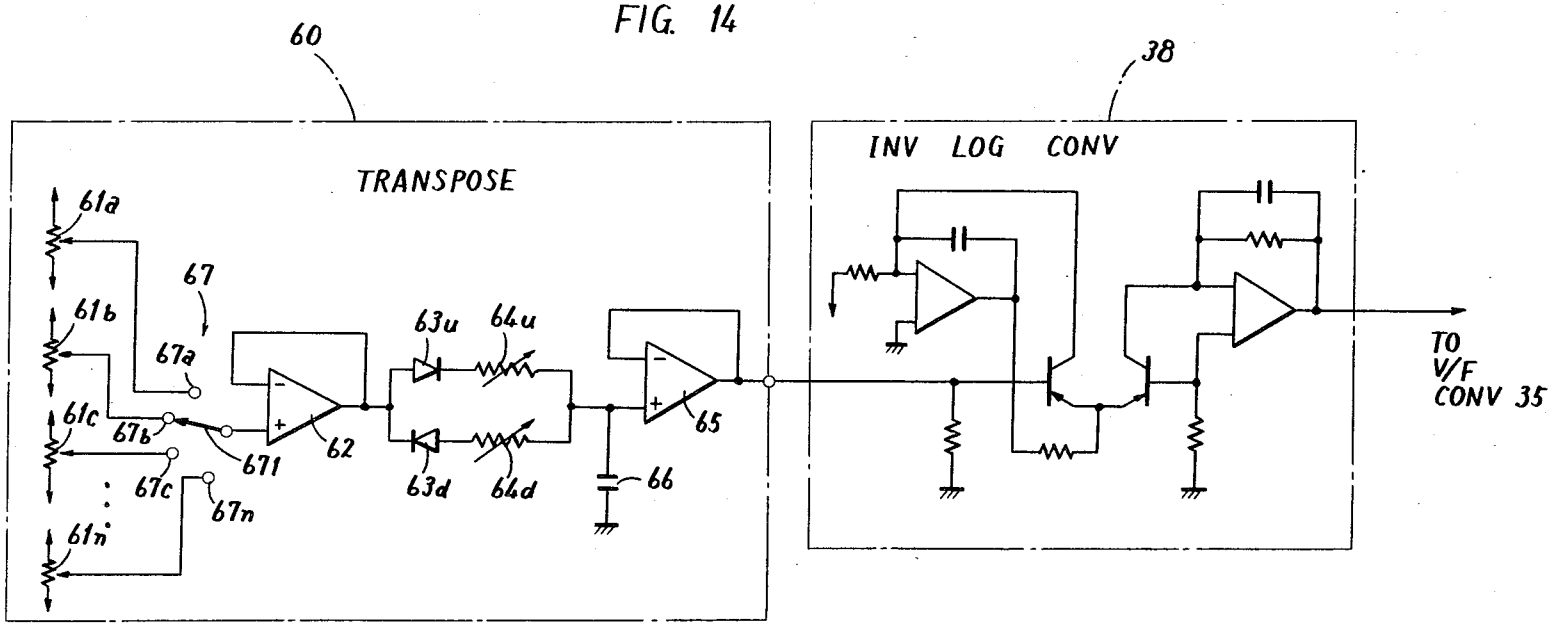
FIG. 14 is a schematic diagram showing in detail a transpose circuit.

Now referring to FIG. 14, the transpose circuit 60 for attaining a sweep effect performance will be described in detail. The sliding terminals of the variable voltage generators 61*a* to 61*n* are connected to the fixed contacts 67*a* to 67*n* of a selection switch 67. The fixed contacts 67*a* to 67*n* are connected through a movable contact 671 selectively switchable through operation of the foot switches 212 and 213 to a buffer amplifier 62.

Figure 6:
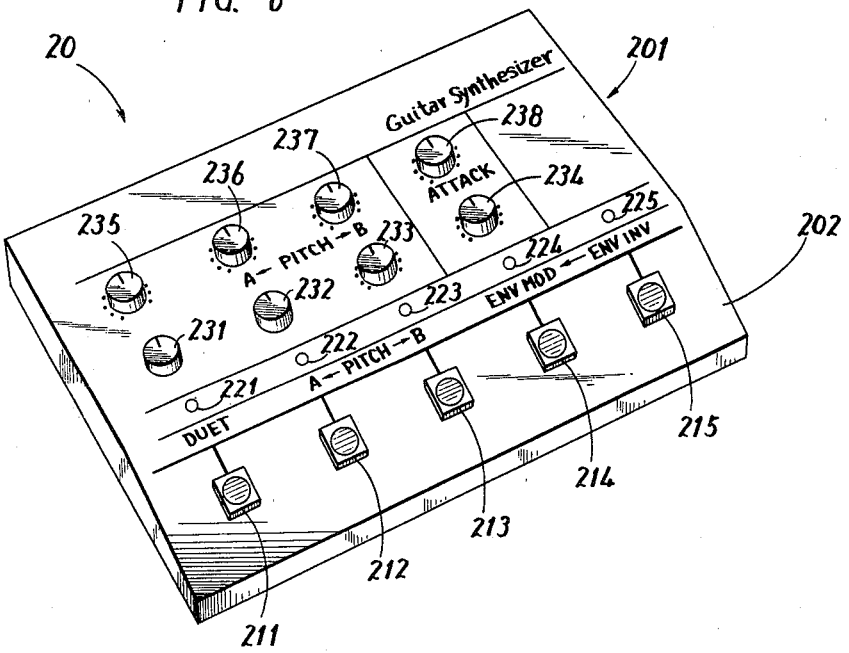
FIG. 6 is a perspective view of a synthesizer portion in accordance with one embodiment of the present invention.

The foot switches 212 and 213 provided on the upper front surface 202 of the casing 201 shown in FIG. 6 are adapted to function so as to selectively turn the movable contact 671 of the switch 67 to the fixed contact 67*a* or 67*b*. For example, depression of the foot switch 212 causes the movable contact 671 to be turned to the fixed contact 67*a* and subsequent depression of the foot switch 213 causes the movable contact 671 to be turned to the fixed contact 67*b*. Further depression of the foot switch 213 causes the movable contact 671 to be turned to the fixed contact which is connected to ground. The foot switches 212 and 213 function such that the connection state of one switch changes when the other switch is depressed while either of them is in the on-state. The output of the buffer amplifier 62 is connected to the input of a buffer amplifier 65 through a series connection of a diode 63*u* and a variable resistor 64*u*. The above described series connection is shunted by a series connection of a diode 63*d* and a variable resistor 64*d* in the reverse direction with respect to the diodes 63*u* and 63*d*. The variable resistors 64*a* and 64*d* are provided so as to be varied by the operation knobs 236 and 237, respectively. A capacitor 66 is connected between the input of the buffer amplifier 65 and ground. The output of the buffer amplifier 65 is applied to the inverse logarithmic converting circuit 38. Since a detailed structure of the inverse logarithmic converting circuit 38 is well known to those skilled in the art, only an illustration of the schematic diagram is shown and a detailed description thereof is omitted.

Figure 15:
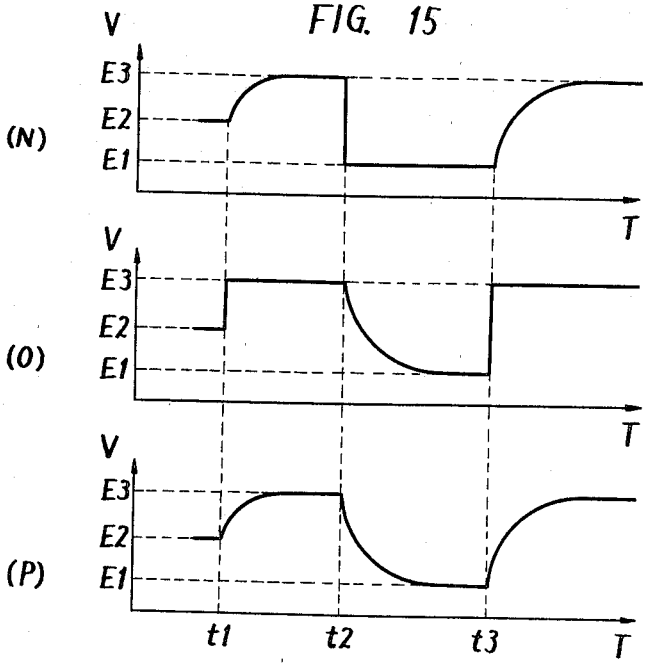
FIG. 15 is a graph showing waveforms for explaining the operation of the transpose circuit.

Now referring to FIGS. 7, 14 and 15, the operation of the transpose circuit will be described for achieving a sweep effect for shifting the pitch of the guitar sound signal and for continuously and gradually changing the pitch. Assuming that the output voltages of the variable resistors 61*a*, 61*b* and 61*c* are E1, E2 and E3, respectively, an operator or a player first manually operates the variable resistors 61*a*, 61*b* and 61*c* so that a relation of the respective voltages may be $E1<E2<E3$ as shown in FIG. 15. In a case where a sweep effect is to be attained only when the sound frequency representing voltage increases, the resistance value of the variable resistor 64*u* is selected to be a given large resistance value and the resistance value of the variable resistor 64*d* is selected to be zero. Thereafter the player operates the foot switches 212 and 213, whereby the moving contact 671 of the selection switch 67 is turned from the fixed contact 67*b* to the fixed contact 67*c* at the timing t1. Accordingly, the voltage E3 set by the variable resistor 61*c* charges the capacitor 66 through the path of the switch 67, the buffer amplifier 62, the diode 63*u* and the variable resistor 64*u*. Therefore, the output voltage of the buffer amplifier 65 increases in accordance with a curve corresponding to the time constant determined by the resistance value of the variable resistor 64*u* and the capacitance of the capacitor 66, whereupon the voltage E3 is reached after a given time period. At the timing t2 the moving contact 671 of the selection switch 67 is turned from the fixed contact 67*c* to the fixed contact 67*a*. Accordingly, the capacitor 66 is discharged to the buffer amplifier 62 through the variable resistor 64*d* and the diode 63*d*. Accordingly, the terminal voltage of the capacitor 66 and thus the output voltage of the buffer amplifier 65 abruptly falls to the voltage E1. The output voltage waveform in such a situation is shown at (N) in FIG. 15. The above described output voltage is applied through the inverse logarithmic converting circuit 38 to the voltage/frequency converting circuit 35. Therefore, the voltage/frequency converting circuit 35 provides a sound source signal the output frequency of which changes in a non-stepwise manner or in a continuous manner only when the sound frequency representing voltage increases. As a result, a sweep effect sound is produced only when the sound pitch increases.

Now an example will be described wherein conversely a sweep effect is to be attained when the sound frequency representing voltage falls. In such a case, the resistance value of the variable resistor 64*u* is selected to be zero and the resistance value of the variable resistor 64*d* is selected to be a given large resistance value. Thereafter the player operates the foot switches 212 and 213, thereby to turn the movable contact 671 of the selection switch 67 to the fixed contact 67*c* at the timing t1 and to turn the movable contact 671 to the fixed contact 67*a* at the timing t2. Then, since the resistance value of the variable resistor 64*u* is zero, the terminal voltage of the capacitor 66 abruptly rises up to the voltage E3 set by the variable resistor 61*c*. Thereafter the capacitor 66 is discharged through the variable resistor 64*d* and the diode 63*d* at the timing t2, whereby the terminal voltage gradually falls. Accordingly, the waveform of the output voltage of the buffer amplifier 65 has a shape as shown at (O) in FIG. 15.

Now an example will be described wherein a sweep effect is attained by the rise and the fall of the sound frequency representing voltage. The player first selects suitable resistance values for the variable resistors 64*u* and 64*d*. Thereafter the movable contact 671 of the switch 67 is turned in the same manner as described above at the timings t1 and t2. As a result, the voltage waveform (P) as shown in FIG. 15 is obtained from the buffer amplifier 65. Accordingly, a sound source signal having a sweep effect both at the rise and the fall of the sound frequency representing voltage is obtained.

The just described sweep effect has the following advantage. Considering the example wherein the switch 67 is turned to a given variable resistor when a given string vibrates with the fret of that string depressed, the musical note signal caused by the string vibration increases due to the sweep effect until the pitch being set by the variable resistor, for example a one octave higher tone, is reached. Thereafter a musical note signal which is the same as that of a one octave higher fret position, i.e. the position far separated by 12 frets, can be generated even at the same depressed position of the string. This means that a tone can be changed even by simply operating the switch 67 in the course of the performance. In other words, the effect of sweeping in the upward direction or in the downward direction of the pitch of the sound, i.e., the so-called portament effect, can be achieved with a given fret depressed and at the same time a tone change can be achieved and therefore the performance can enter into a high tone as shifted while the same fret position is maintained.

By suitably adjusting the resistance values of the variable resistors 64*u* and 64*d*, the charging/discharging time constant of the capacitor 66 and thus the output voltage of the buffer amplifier 65 can be arbitrarily adjusted and the degree of the sweep effect may be freely controlled.

The variable resistor 64*u* serves as an increasing voltage setting means for changeably setting the increasing speed. The variable resistor 64*d* also serves as a decreasing voltage setting means for setting a decreasing time period.

Figure 16:
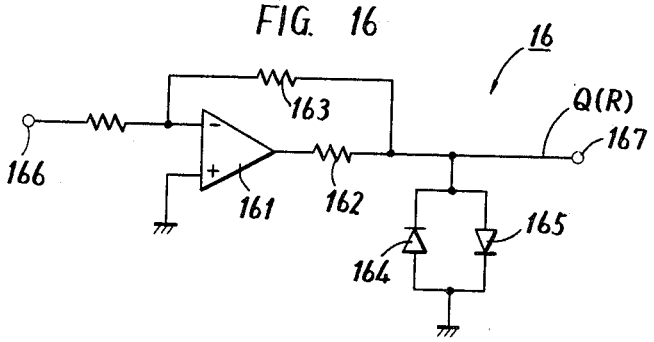
FIG. 16 is a schematic diagram showing in detail a distortion circuit.

Now referring to FIG. 16, the distortion circuit 16 included in the above described guitar amplifier 15 will now be specifically described. The distortion circuit 16 comprises a parallel connection of oppositely disposed diodes 164 and 165 connected between the junction of resistors 162 and 163 constituting the feedback circuit of an amplifier 161 and ground.

Figure 17:
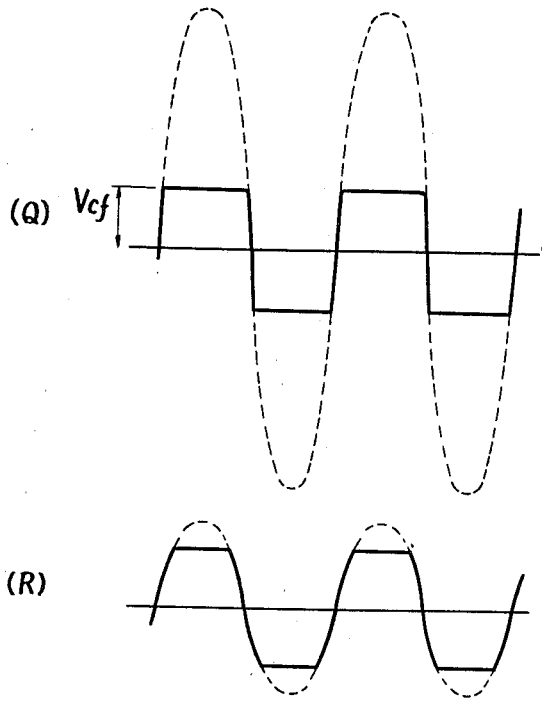
FIG. 17 is a graph showing waveforms for explaining the operation of the distortion circuit.

If and when the guitar sound signal of a sine wave as detected by the above described pickup portion is applied to the input terminal 166, the amplifier 161 functions as an ordinary amplifier during the cutoff period of the diodes 164 and 165. Therefore, the input voltage and the output voltage come to have a proportional relation. However, if and when the output voltage exceeds the cutoff voltage Vcf of the diode 165, the diode 165 starts turning on, so that the resistance value by the diode 165 connected between the junction of the resistors 162 and 163 and ground decreases and the amplification factor of the amplifier 161 constituting the feedback circuit increases, whereby the diode 165 is rendered conductive. More specifically, a voltage exceeding a given positive level of the guitar sound signal of a sine wave is sharply clipped. Furthermore, even if the guitar sound signal assumes the opposite polarity, the signal is sharply clipped at the cutoff voltage level of the negative polarity by means of the diode 164. Accordingly, a waveform of a distortion sound as shown at (Q) in FIG. 17 is obtained from the output terminal 167. Even when the amplitude of the input guitar sound note signal is small, the voltage being clipped is primarily determined by the cutoff voltages of the diodes 164 and 165 and as a result, the waveform as shown at (R) in FIG. 17 is obtained. As a result, a distortion sound of a sharp waveform as clipped is obtained with a simple circuit configuration, while the signal to noise ratio is also improved.

The distortion sound obtained from the above described output terminal 167 is supplied to the input terminal of the tone forming circuit 50 for the purpose of further characterization.

Figure 18:
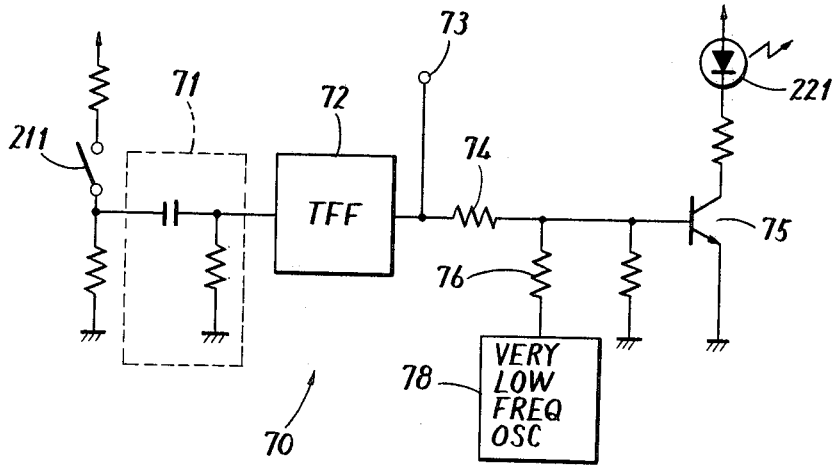
FIG. 18 is a schematic diagram showing in detail a foot switch display control circuit.

Now referring to FIG. 18, the structure and operation of the foot switch display control circuit 70 will be described. Consider a case where the foot switch such as the switch 211 is depressed in a situation where the output of a toggle type flip-flop 72 is at the low level. As the foot switch is depressed, a differentiated pulse is obtained from a differentiation circuit 71, whereby the output of the toggle type flip-flop 72 is turned to the high level. The high level output of the toggle type flip-flop 72 is taken from the output terminal 73 as a signal for commanding a certain performance state such as a duet performance in association with the depression of the foot switch and the signal is applied to the transistor 75, thereby to continuously render the same conductive. Accordingly, a light-emitting diode 221 is continuously enabled to emit light during the conduction period of the transistor 75. The continuous light-emitting state of the light-emitting diode 221 notifies the player of the depressed state of the foot switch 211 even in a dark place.

If and when the foot switch 211 is again depressed, a differentiated pulse is obtained from the differentiation circuit 71, whereby the output of the toggle type flip-flop 72 is turned to the low level. Therefore, the signal for commanding the performance in association with the foot switch 211 obtained from the output terminal 73 of the toggle type flip-flop 72, is terminated. Thus, when the output of the toggle type flip-flop 72 assumes the low level, the output pulse of a very low frequency oscillator 78 is applied through a resistor 76 to the base electrode of the transistor 75. The transistor 75 repeats an on/off operation in synchronism with the output pulse of the very low frequency oscillator 78, thereby to make a blinking display by the light-emitting diode 221. As a result, the player learns that the performance state in association with the foot switch 211 has not been selected and at the same time he learns where the foot switch is located even in the dark place and during the performance.

Although in the illustration the display control circuit for only the light-emitting diode corresponding to one foot switch was depicted for simplicity of illustration, it is pointed out that corresponding circuits are provided for respective additional foot switches in the case where a plurality of foot switches are employed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A guitar synthesizer, comprising: a guitar portion (10) including strings stretched between a bridge and a nut and pickup means (12) associated with said strings for detecting a string vibration and providing a guitar sound signal in response to a string vibration, said guitar sound signal including a fundamental wave component and harmonics, signal source means (15) for generating a fundamental wave associated signal in response to said guitar sound signal, said fundamental wave associated signal having the frequency of said fundamental wave component included in said guitar sound signal, said signal source means for generating said fundamental wave associated signal comprising voltage controlled variable bandpass filter means (41) having a variable passband characteristic coupled to said pickup means and responsive to a control voltage for varying said passband characteristic in response to the frequencies of said guitar sound signal as a function of said control voltage, frequency/voltage converting means (42) responsive to said voltage controlled variable bandpass filter means for converting the frequency of the output of said voltage controlled variable bandpass filter means into a voltage representing the frequency of said output of said voltage controlled variable bandpass filter means (41), circuit means for applying said frequency representing voltage to said voltage controlled variable bandpass filter means (41) as said control voltage for adapting said passband characteristic of said voltage controlled variable bandpass filter means (41) to the frequency of said fundamental wave component included in said guitar sound signal, whereby said signal source means (15) is adaptively and dominantly responsive to the frequency of said fundamental wave component included in said guitar sound signal, voltage/frequency converting means (35) operatively connected to said frequency/voltage converting means (42) for providing a sound source signal having the frequency of said fundamental wave component included in said guitar sound signal, envelope signal providing means (31) responsive to said pickup means for detecting a signal envelope of said guitar sound signal and providing an envelope signal representing the envelope of said guitar sound signal, and sound synthesizing means (36) responsive to said sound source signal from said voltage/frequency converting means and to said envelope signal for modulating said sound source signal with said envelope signal for synthesizing a synthesized guitar tone, wherein said signal source means (15) for generating said fundamental wave associated signal further comprises level detecting means responsive to said frequency/voltage converting means (42) for level detecting said frequency associated voltage at a predetermined level for applying the level detected output to said voltage controlled variable bandpass filter means (41) as said control voltage, whereby the passband characteristic of said voltage controlled variable bandpass filter means is controlled by said level detected output of said level detecting means, wherein said frequency/-voltage converting means comprises period/voltage converting means responsive to said voltage controlled variable bandpass filter means for converting the period of each cycle of the output of said voltage controlled variable bandpass filter means into a voltage associated with the period of each cycle of said output of said voltage controlled variable bandpass filter means, and wherein said frequency/voltage converting means comprises first sawtooth wave signal generating means responsive to the output of said voltage controlled variable bandpass filter means (41) for generating, as said fundamental wave associated signal, a first sawtooth wave signal associated with the period of a succeeding cycle of the fundamental wave component.

2. The guitar synthesizer in accordance with claim 1, wherein said voltage controlled variable bandpass filter means (41) comprises voltage controlled variable low pass filter means, the cutoff frequency of which is variable as a function of said control voltage.

3. The guitar synthesizer in accordance with claim 1, wherein said sound synthesizing means (36) comprises first sound synthesizing means responsive to said first sawtooth wave signal and to said envelope signal for modulating said first sawtooth wave signal with said envelope signal for synthesizing a first synthesized guitar tone, and second sound synthesizing means responsive to said sound source signal and said envelope signal for modulating said sound source signal with said envelope signal for synthesizing a second synthesizing guitar tone, and which further comprises duet effect enabling means for mixing said first and second synthesized guitar tones.

4. The guitar synthesizer in accordance with claim 1, wherein said pickup means comprises a plurality of pickup portions which correspond independently to said strings.

5. The guitar synthesizer in accordance with claim 4, wherein each of said pickup portions comprises two magnetic cores provided in parallel and magnetized to have opposite polarities, and coils wound on said magnetic cores in the opposite directions to each other and connected in series, whereby the electric currents induced in said coils are offset when a common external disturbance magnetic field is applied to said coils.

6. The guitar synthesizer in accordance with claim 1, wherein said guitar portion further includes amplifying means for amplifying said guitar sound note signal detected by said pickup means.

7. The guitar synthesizer in accordance with claim 6, wherein said amplifying means comprises distortion circuit means for clipping said guitar sound signal detected by said pickup means at a predetermined level for causing a distortion in said guitar sound signal.

8. The guitar synthesizer in accordance with claim 7, wherein said distortion circuit comprises an amplifier having an input and an output, an output terminal, a first resistor coupled between said output of said amplifier and said output terminal, a second resistor coupled between said input of said amplifier and said output terminal, and two diodes coupled in parallel in the opposite directions between said output terminal and the ground.

9. The guitar synthesizer in accordance with claim 1, wherein said voltage/frequency converting means comprises voltage/period converting means responsive to said period/voltage converting means for converting the output voltage of said period/voltage converting means into a sound source signal having the period of each cycle associated with said output voltage of said period/voltage converting means.

10. The guitar synthesizer in accordance with claim 1, wherein said voltage controlled variable bandpass filter means comprises filter circuit means coupled to said pick-up means and responsive to said control voltage for exhibiting at least two predetermined distinctive and selective passband characteristics selected for allowing said guitar sound signal from said pick-up means to pass through one of said passband characteristics determined as a function of said control voltage, and selective controlling means responsive to said control voltage for controlling said filter circuit means for selectively allowing said guitar sound signal to pass through at least one of said passband characteristics of said filter circuit means determined as a function of said control voltage.

11. The guitar synthesizer in accordance with claim 10, wherein said filter circuit means comprises circuit components having a connection determining said at least two passband characteristics, and wherein said selective controlling means comprises switching means responsive to said control voltage for changing said connection of said circuit components for selecting one of said passband characteristics having the frequencies of said guitar sound signal as a function of said control voltage.

12. A guitar synthesizer, comprising: a guitar portion (10) including strings stretched between a bridge and a nut and pickup means (12) associated with said strings for detecting a string vibration and providing a guitar sound signal in response to a string vibration, said guitar sound signal including a fundamental wave component and harmonics, signal source means (15) for generating a fundamental wave associated signal in response to said guitar sound signal, said fundamental wave associated signal having the frequency of said fundamental wave component included in said guitar sound signal, said signal source means for generating said fundamental wave associated signal comprising voltage controlled variable bandpass filter means (41) having a variable passband characteristic coupled to said pickup means and responsive to a control voltage for varying said passband characteristic in response to the frequencies of said guitar sound signal as a function of said control voltage, frequency/voltage converting means (42) responsive to said voltage controlled variable bandpass filter means for converting the frequency of the output of said voltage controlled variable bandpass filter means into a voltage representing the frequency of said output of said voltage controlled variable bandpass filter means (41), circuit means for applying said frequency representing voltage to said voltage controlled variable bandpass filter means (41) as said control voltage for adapting said passband characteristic of said voltage controlled variable bandpass filter means (41) to the frequency of said fundamental wave component included in said guitar sound signal, whereby said signal source means (15) is adaptively and dominantly responsive to the frequency of said fundamental wave component included in said guitar sound signal, voltage/frequency converting means (35) operatively connected to said frequency/voltage converting means (42) for providing a sound source signal having the frequency of said fundamental wave component included in said guitar sound signal, envelope signal providing means (31) responsive to said pickup means for detecting a signal envelope of said guitar sound signal and providing an envelope signal representing the envelope of said guitar sound signal, and sound synthesizing means (36) responsive to said sound source signal from said voltage/frequency converting means and to said envelope signal for modulating said sound source signal with said envelope signal for synthesizing a synthesized guitar tone, and wherein said frequency/voltage converting means (42) comprises sawtooth wave signal generating means responsive to the output of said voltage controlled variable bandpass filter means (41) for generating, as said fundamental wave associated signal, a sawtooth wave signal in synchronism with the frequency of the fundamental wave component included in said guitar sound signal.

13. The guitar synthesizer in accordance with claim 12, wherein said sound synthesizing means comprises modulating means responsive to said sawtooth wave signal and said envelope signal for modulating said sawtooth wave signal with said envelope signal for synthesizing a synthesized guitar tone.

14. The guitar synthesizer in accordance with claim 12, wherein said frequency/voltage converting means comprises holding means responsive to said sawtooth wave generating means for holding the maximum value of said sawtooth wave signal.

15. The guitar synthesizer in accordance with claim 14, wherein said holding means comprises second trigger pulse generating means responsive to the output of said voltage controlled variable bandpass filter means for providing a second trigger pulse in synchronism with the cycle of said fundamental wave component included in said guitar sound signal, and sample holding means responsive to said sound trigger pulse for sample holding the maximum value of said sawtooth wave signal.

16. The guitar synthesizer in accordance with claim 12, wherein said sawtooth wave signal generating means comprises first trigger pulse generating means responsive to the output of said voltage controlled variable bandpass filter means for providing a first trigger pulse in synchronism with a cycle of the fundamental wave component included said guitar sound signal, and a first sawtooth wave generator responsive to said first trigger pulse for generating, as said fundamental wave associated signal, a first sawtooth wave signal in synchronism with said first trigger pulse.

17. The guitar synthesizer in accordance with claim 16, wherein said voltage/frequency converting means comprises sawtooth wave signal generating means responsive to the output of said frequency/voltage converting means for generating, as said sound source signal, a sawtooth wave signal having the frequency of said fundamental wave component.

18. The guitar synthesizer in accordance with claim 17, wherein said sound synthesizing means comprises modulating means responsive to said sawtooth wave signal and said envelope signal for modulating said sawtooth wave signal with said envelope signal for synthesizing a synthesized guitar tone.

19. The guitar synthesizer in accordance with claim 16, wherein said frequency/voltage converting means comprises holding means responsive to said sawtooth wave generating means for holding the maximum value of said first sawtooth wave signal.

20. The guitar synthesizer in accordance with claim 19, wherein said holding means comprises second trigger pulse generating means responsive to the output of said voltage controlled variable bandpass filter means for providing a second trigger pulse in synchronism with the cycle of said fundamental wave component included in said guitar sound signal, and sample holding means responsive to said sound trigger pulse for sample holding a maximum value of said first sawtooth wave signal, said first trigger pulse generating means and said second trigger pulse generating means are adapted such that said first trigger pulse is generated immediately after said second trigger pulse, whereby said maximum value of said first sawtooth wave signal is sample held associated with the preceding cycle of the fundamental wave component, and said first sawtooth wave signal is generated associated with the succeedinng cycle of said fundamental wave component.

21. The guitar synthesizer in accordance with claim 20, wherein said voltage/frequency converting means comprises a second sawtooth wave signal generator means responsive to the output of said sample holding means for generating, as said sound source signal, a second sawtooth wave signal having the frequency of said fundamental wave component.

22. The guitar synthesizer in accordance with claim 21, wherein first sound synthesizing means responsive to said first sawtooth wave signal and said envelope signal for modulating said first sawtooth wave signal with said envelope signal for synthesizing a first synthesized guitar tone, and second sound synthesizing means responsive to said sound source signal and said envelope signal for modulating said second sawtooth wave signal with said envelope signal for synthesizing a second synthesized guitar tone, and which further comprises duet effect enabling means for mixing said first and second synthesized guitar tones.

23. A guitar synthesizer, comprising: a guitar portion (10) including strings stretched between a bridge and a nut and pickup means (12) associated with said strings for detecting a string vibration and providing a guitar sound signal in response to a string vibration, said guitar sound signal including a fundamental wave component and harmonics, signal source means (15) for generating a fundamental wave associated signal in response to said guitar sound signal, said fundamental wave associated signal having the frequency of said fundamental wave component included in said guitar sound signal, said signal source means for generating said fundamental wave associated signal comprising voltage controlled variable bandpass filter means (41) having a variable passband characteristic coupled to said pickup means and responsive to a control voltage for varying said passband characteristic in responsive to the frequencies of said guitar sound signal as a function of said control voltage, frequency/voltage converting means (42) responsive to said voltage controlled variable bandpass filter means for converting the frequency of the output of said voltage controlled variable bandpass filter means into a voltage representing the frequency of said output of said voltage controlled variable bandpass filter means (41), circuit means for applying said frequency representing voltage to said voltage controlled variable bandpass filter means (41) as said control voltage for adapting said passband characteristic of said voltage controlled variable bandpass filter means (41) to the frequency of said fundamental wave component included in said guitar sound signal, whereby said signal source means (15) is adaptively and dominantly responsive to the frequency of said fundamental wave component included in said guitar sound signal, voltage/frequency converting means (35) operatively connected to said frequency/voltage converting means (42) for providing a sound source signal having the frequency of said fundamental wave component included in said guitar sound signal, envelope signal providing means (31) responsive to said pickup means for detecting a signal envelope of said guitar sound signal and providing an envelope signal representing the envelope of said guitar sound signal, and sound synthesizing means (36) responsive to said sound source signal from said voltage/frequency converting means and to said envelope signal for modulating said sound source signal with said envelope signal for synthesizing a synthesized guitar tone, wherein said envelope signal providing means (31) comprises signal dividing means having first and second output terminals, said signal dividing means being responsive to said guitar sound signal for providing at said first output terminal a sound signal of the same phase as said guitar sound signal and for providing a sound signal of the opposite phase at said second output terminal, first rectifying means including a series connection of a first capacitor and a first diode coupled between said first output terminal and a reference potential for rectifying said sound signal of the same phase, second rectifying means including a second capacitor and a second diode coupled between said second output terminal and said reference potential for rectifying said sound signal of the opposite phase, and signal adding means coupled to said first and second rectifying means for adding the rectified outputs from said first and second rectifying means, whereby a separate smoothing circuit is avoided.

24. A guitar synthesizer, comprising: a guitar portion (10) including strings stretched between a bridge and a nut and pickup means (12) associated with said strings for detecting a string vibration and providing a guitar sound signal in response to a string vibration, said guitar sound signal including a fundamental wave component and harmonics, signal source means (15) for generating a fundamental wave associated signal in response to said guitar sound signal, said fundamental wave associated signal having the frequency of said fundamental wave component included in said guitar sound signal, said signal source means for generating said fundamental wave associated signal comprising voltage controlled variable bandpass filter means (41) having a variable passband characteristic coupled to said pickup means and responsive to a control voltage for varying said passband characteristic in response to the frequencies of said guitar sound signal as a function of said control voltage, frequency/voltage converting means (42) responsive to said voltage controlled variable bandpass filter means for converting the frequency of the output of said voltage controlled variable bandpass filter means into a voltage representing the frequency of said output of said voltage controlled variable bandpass filter means (41), circuit means for applying said frequency representing voltage to said voltage controlled variable bandpass filter means (41) as said control voltage for adapting said passband characteristic of said voltage controlled variable bandpass filter means (41) to the frequency of said fundamental wave component included in said guitar sound signal, whereby said signal source means (15) is adaptively and dominantly responsive to the frequency of said fundamental wave component included in said guitar sound signal, voltage/frequency converting means (35) operatively connected to said frequency/voltage converting means (42) for providing a sound source signal having the frequency of said fundamental wave component included in said guitar sound signal, envelope signal providing means (31) responsive to said pickup means for detecting a signal envelope of said guitar sound signal and providing an envelope signal representing the envelope of said guitar sound signal, and sound synthesizing means (36) responsive to said sound source signal from said voltage/frequency converting means and to said envelope signal for modulating said sound source signal with said envelope signal for synthesizing a synthesized guitar tone, said synthesizer further comprising disabling means responsive to an abrupt variation of the frequency of said fundamental wave component included in said guitar sound signal for disabling said envelope signal providing means.

25. The guitar synthesizer in accordance with claim 24, wherein said frequency/voltage converting means comprises first frequency/voltage converting means responsive to said voltage controlled variable bandpass filter means (41) for converting the frequency of a preceding cycle of the fundamental wave component into a first voltage associated with the frequency of said preceding cycle of said fundamental wave component, and second frequency/voltage converting means responsive to said voltage controlled variable bandpass filter means (41) for converting the frequency of a succeeding cycle of the fundamental wave component into a second voltage associated with the frequency of said succeeding cycle of said fundamental wave component, and said disabling means comprises difference evaluating means responsive to said first and second frequency/voltage converting means for evaluating a voltage difference between said first and second voltages, and disabling control means responsive to said difference evaluating means for disabling said envelope signal generating means in response to said voltage difference reaching a predetermined value.

26. The guitar synthesizer in accordance with claim 25, wherein said disabling means further comprises difference level detecting means responsive to said difference evaluating means for level detecting said difference, and said disabling control means is responsive to said level detected output of said difference level detecting means for disabling said envelope signal generating means as a function of said level detected output.

27. The guitar synthesizer in accordance with claim 24, wherein said disabling control means is adapted to be responsive to an abrupt change of the frequency of a succeeding cycle of the fundamental wave component as compared with the frequency of a preceding cycle to disable said envelope signal generating means.

28. A guitar synthesizer, comprising: a guitar portion (10) including strings stretched between a bridge and a nut and pickup means (12) associated with said strings for detecting a string vibration and providing a guitar sound signal in response to a string vibration, said guitar sound signal including a fundamental wave component and harmonics, signal source means (15) for generating a fundamental wave associated signal in response to said guitar sound signal, said fundamental wave associated signal having the frequency of said fundamental wave component included in said guitar sound signal, said signal source means for generating said fundamental wave associated signal comprising voltage controlled variable bandpass filter means (41) having a variable passband characteristic coupled to said pickup means and responsive to a control voltage for varying said passband characteristic in response to the frequencies of said guitar sound signal as a function of said control voltage, frequency/voltage converting means (42) responsive to said voltage controlled variable bandpass filter means for converting the frequency of the output of said voltage controlled variable bandpass filter means into a voltage representing the frequency of said output of said voltage controlled variable bandpass filter means (41), circuit means for applying said frequency representing voltage to said voltage controlled variable bandpass filter means (41) as said control voltage for adapting said passband characteristic of said voltage controlled variable bandpass filter means (41) to the frequency of said fundamental wave component included in said guitar sound signal, whereby said signal source means (15) is adaptively and dominantly responsive to the frequency of said fundamental wave component included in said guitar sound signal, voltage/frequency converting means (35) operatively connected to said frequency/voltage converting means (42) for providing a sound source signal having the frequency of said fundamental wave component included in said guitar sound signal, envelope signal providing means (31) responsive to said pickup means for detecting a signal envelope of said guitar sound signal and providing an envelope signal representing the envelope of said guitar sound signal, and sound synthesizing means (36) responsive to said fundamental sound source signal from said voltage/frequency converting means and to said envelope signal for modulating said sound source signal with said envelope signal for synthesizing a synthesized guitar tone, and further comprising sweep effect enabling switch means for enabling said sound source signal to attain a sweep effect performance, and transpose circuit means responsive to said sweep effect enabling switch means for applying an increasing/decreasing output voltage to said voltage/frequency converting means for varying the output frequency of said voltage/frequency converting means.

29. The guitar synthesizer in accordance with claim 28, wherein said increasing/decreasing output voltage is gradually applied to said voltage/frequency converting means by said transpose circuit means.

30. The guitar synthesizer in accordance with claim 28, wherein said transpose circuit means comprises, a plurality of variable voltage generating means, selection switch means for selecting any one of said plurality of variable voltage generating means for commanding a sweep effect performance, capacitor means connected for being charged/discharged by a voltage obtained through said selection switch means, a first series connection of a unidirectional conductive element and a gradually increasing speed varying resistor operatively connected in said charging path, and a second series connection of a unidirectional element and a gradually decreasing speed varying resistor operatively connected in said discharging path and coupled in the reverse polarity with respect to said unidirectional conductive elements of said first and second series connections.

31. The guitar synthesizer in accordance with claim 28, wherein said transpose circuit means comprises a plurality of voltage setting means for setting voltage values associated with frequencies to which the frequency of said guitar sound signal is to be changed; selecting means for selecting any one of said plurality of voltage setting means of a desired frequency to which said change is to be made, first time constant setting means for setting a time constant for increasing the voltage to a value associated with said desired frequency to which said change is to be made which frequency was selected by said selecting means, and second time constant setting means for setting a time constant for decreasing the voltage to a value associated with said desired frequency to which said change is to be made which frequency was selected by said selecting means.

32. The guitar synthesizer in accordance with claim 31, wherein said first and second time constant setting means provide for a gradual increase and decrease of said voltage.

33. A guitar synthesizer, comprising: a guitar portion (10) including strings stretched between a bridge and a nut and pickup means (12) associated with said strings for detecting a string vibration and providing a guitar sound signal in response to a string vibration, said guitar sound signal including a fundamental wave component and harmonics, signal source means (15) for generating a fundamental wave associated signal in response to said guitar sound signal, said fundamental wave associated signal having the frequency of said fundamental wave component included in said guitar sound signal, said signal source means for generating said fundamental wave associated signal comprising voltage controlled variable bandpass filter means (41) having a variable passband characteristic coupled to said pickup means and responsive to a control voltage for varying said passband characteristic in response to the frequencies of said guitar sound signal as a function of said control voltage, frequency/voltage converting means (42) responsive to said voltage controlled variable bandpass filter means for converting the frequency of the output of said voltage controlled variable bandpass filter means into a voltage representing the frequency of said output of said voltage controlled variable bandpass filter means (41), circuit means for applying said frequency representing voltage to said voltage controlled variable bandpass filter means (41) as said control voltage for adapting said passband characteristic of said voltage controlled variable bandpass filter means (41) to the frequency of said fundamental wave component included in said guitar sound signal, whereby said signal source means (15) is adaptively and dominantly responsive to the frequency of said fundamental wave component included in said guitar sound signal, voltage/frequency converting means (35) operatively connected to said frequency/voltage converting means (42) for providing a sound source signal having the frequency of said fundamental wave component included in said guitar sound signal, envelope signal providing means (31) responsive to said pickup means for detecting a signal envelope of said guitar sound signal and providing an envelope signal representing the envelope of said guitar sound signal, and sound synthesizing means (36) responsive to said sound source signal from said voltage/frequency converting means and to said envelope signal for modulating said sound source signal with said envelope signal for synthesizing a synthesized guitar tone, wherein said voltage controlled variable bandpass filter means comprises filter circuit means coupled to said pickup means and responsive to said control voltage for exhibiting at least two predetermined distinctive and selective passband characteristics selected for allowing said guitar sound signal from said pickup means to pass through one of said passband characteristics determined as a function of said control voltage, and selective controlling means responsive to said control voltage for controlling said filter circuit means for selectively allowing said guitar sound signal to pass through at least one of said passband characteristics of said filter circuit means determined as a function of said control voltage, and wherein said filter circuit means comprises at least two frequency splitting filter means each exhibiting the passband characteristics of the corresponding one of at least two frequency regions of the frequencies of said guitar sound signal, and said selective controlling means comprises selective enabling means responsive to said control voltage for selectively enabling one of said at least two frequency splitting filter means as a function of said control voltage, whereby the passband characteristics of said voltage controlled variable bandpass filter means is changed into said at least two frequency regions of the frequencies of said guitar sound signal as a function of said control voltage.

* * * * *

UNITED STATES PATENT AND TRADEMARK OFFICE

CERTIFICATE OF CORRECTION

PATENT NO. : 4,357,852

DATED : November 9, 1982

INVENTOR(S) : Noboru Suenaga

It is certified that error appears in the above-identified patent and that said Letters Patent is hereby corrected as shown below:

Claim 15, column 25, line 54, replace "sound" by --second--.

Claim 20, column 26, line 28, replace "sound" by --second--;
line 39, replace "succeedinng" by --succeeding--.

Signed and Sealed this

First Day of March 1983

[SEAL]

Attest:

GERALD J. MOSSINGHOFF

Attesting Officer

Commissioner of Patents and Trademarks